US011128976B2

(12) United States Patent
Munoz et al.

(10) Patent No.: US 11,128,976 B2
(45) Date of Patent: Sep. 21, 2021

(54) REPRESENTING OCCLUSION WHEN RENDERING FOR COMPUTER-MEDIATED REALITY SYSTEMS

(71) Applicant: QUALCOMM Incorporated, San Diego, CA (US)

(72) Inventors: Isaac Garcia Munoz, San Diego, CA (US); Siddhartha Goutham Swaminathan, San Diego, CA (US); S M Akramus Salehin, San Diego, CA (US); Moo Young Kim, San Diego, CA (US); Nils Günther Peters, San Diego, CA (US); Dipanjan Sen, Dublin, CA (US)

(73) Assignee: QUALCOMM Incorporated, San Diego, CA (US)

( * ) Notice: Subject to any disclaimer, the term of this patent is extended or adjusted under 35 U.S.C. 154(b) by 137 days.

(21) Appl. No.: 16/584,614

(22) Filed: Sep. 26, 2019

(65) Prior Publication Data

US 2020/0107147 A1 Apr. 2, 2020

Related U.S. Application Data

(60) Provisional application No. 62/740,085, filed on Oct. 2, 2018.

(51) Int. Cl.
*H04S 7/00* (2006.01)
*H04R 3/04* (2006.01)
(Continued)

(52) U.S. Cl.
CPC ..... *H04S 7/303* (2013.01); *H04R 3/04* (2013.01); *H04R 5/02* (2013.01); *H04R 5/04* (2013.01);
(Continued)

(58) Field of Classification Search
USPC ..... 381/22, 23.1, 26, 61, 63, 303, 309, 310
See application file for complete search history.

(56) References Cited

U.S. PATENT DOCUMENTS 6,917,686 B2 * 7/2005 Jot ..... H04S 3/00 381/61
6,973,192 B1 12/2005 Gerrard et al.
(Continued)

FOREIGN PATENT DOCUMENTS

WO 2008040805 A1 4/2008

OTHER PUBLICATIONS

Audio: "Call for Proposals for 30 Audio", International Organisation for Standardisation Organisation Internationale De Normalisation ISO/IEC JTC1/SC29/WG11 Coding of Moving Pictures and Audio, ISO/IEC JTC1/SC29/WG11/N13411, Geneva, Jan. 2013, pp. 1-20.
(Continued)

*Primary Examiner* — Yosef K Laekemariam
(74) *Attorney, Agent, or Firm* — Qualcomm Incorporated

(57) ABSTRACT

In general, techniques are described for modeling occlusions when rendering audio data. A device comprising a memory and one or more processors may perform the techniques. The memory may store audio data representative of a soundfield. The one or more processors may obtain occlusion metadata representative of an occlusion within the soundfield in terms of propagation of sound through the occlusion, the occlusion separating the soundfield into two or more sound spaces. The one or more processors may obtain a location of the device, and obtain, based on the occlusion metadata and the location, a renderer by which to render the audio data into one or more speaker feeds that account for propagation of the sound in one of the two or more sound spaces in which the device resides. The one or
(Continued)

more processors may apply the renderer to the audio data to generate the speaker feeds.

28 Claims, 16 Drawing Sheets

(51) Int. Cl.
*H04R 5/02* (2006.01)
*H04R 5/04* (2006.01)
*H04S 3/00* (2006.01)

(52) U.S. Cl.
CPC ..... *H04S 3/008* (2013.01); *H04S 2400/01* (2013.01); *H04S 2400/11* (2013.01); *H04S 2400/13* (2013.01); *H04S 2420/03* (2013.01)

(56) References Cited

U.S. PATENT DOCUMENTS

| | | | | |
|---|---|---|---|---|
| 8,442,244 | B1 | 5/2013 | Long, Jr. | |
| 8,831,255 | B2 * | 9/2014 | Crawford | H04S 7/306 381/309 |
| 2011/0249821 | A1 | 10/2011 | Jaillet et al. | |
| 2012/0206452 | A1 * | 8/2012 | Geisner | H04S 7/304 345/419 |
| 2018/0206057 | A1 | 7/2018 | Kim et al. | |
| 2019/0007781 | A1 | 1/2019 | Peters et al. | |

OTHER PUBLICATIONS

"Audio Source", Unity User Manual, Version: 2018.2, Retrieved from the Internet: https://docs.unity3d.com/Manual/class-AudioSource.html, Sep. 15, 2018, 5 pages.
ETSI TS 103 589 V1.1.1, "Higher Order Ambisonics (HOA) Transport Format", Jun. 2018, 33 pages.
Fazi F.M., et al., "Sound Field Reproduction as an Equivalent Acoustical Scattering Problem", The Journal of the Acoustical Society of America, vol. 134, 3721 (2013), DOI: 10.1121/1.4824343, pp. 3721-3729.
Herre, et al., "MPEG-H 3D Audio—The New Standard for Coding of Immersive Spatial Audio," IEEE Journal of Selected Topics in Signal Processing, vol. 9, No. 5, Aug. 2015, pp. 770-779.
Hollerweger F., "An Introduction to Higher Order Ambisonic," Oct. 2008, p. 13, Accessed online [Jul. 8, 2013] at URL: flo.mur.at/writings/HOA-intro.pdf.
"Information technology—High Efficiency Coding and Media Delivery in Heterogeneous Environments—Part 3: 3D Audio," ISO/IEC JTC 1/SC 29/WG11, ISO/IEC 23008-3, 201x(E), Oct. 12, 2016, 797 Pages.
"Information technology—High efficiency coding and media delivery in heterogeneous environments—Part 3: Part 3: 3D Audio, Amendment 3: MPEG-H 3D Audio Phase 2," ISO/IEC JTC 1/SC 29N, ISO/IEC 23008-3:2015/PDAM 3, Jul. 25, 2015, 208 pp.
"Information technology—High efficiency coding and media delivery in heterogeneous environments—Part 3: 3D Audio," ISO/IEC JTC 1/SC 29N, Apr. 4, 2014, 337 pp.
International Search Report and Written Opinion—PCT/US2019/053837—ISA/EPO—dated Dec. 12, 2019.
ISO/IEC DIS 23008-3 Information Technology—High Efficiency coding and media delivery in heterogeneous environments—Part 3: 3D audio, Jul. 25, 2014 (Jul. 25, 2014), XP055205625, Retrieved from the Internet URL: http://mpeg.chiariglione.org/standards/mpeg-h/3d-audio/dis-mpeg-h-3d-audio [retrieved on Jul. 30, 2015], 433 pages.
Long M., "Architectural Acoustics", Elsevier Academic Press, 2006, pp. 1-844.
Peterson J., et al., "Virtual Reality, Augmented Reality, and Mixed Reality Definitions," EMA, version 1.0, Jul. 7, 2017, 4 pp.
Poletti, M.A., "Three-Dimensional Surround Sound Systems Based on Spherical Harmonics", The Journal of the Audio Engineering Society, vol. 53, No. 11, Nov. 2005, pp. 1004-1025.
Schonefeld V., "Spherical Harmonics," Jul. 1, 2005, XP002599101, 25 Pages, Accessed online [Jul. 9, 2013] at URL:http://heim.c-otto.de/~volker/prosem_paper.pdf.
Sen D., et al., "RM1-HOA Working Draft Text", 107. MPEG Meeting; Jan. 13, 2014-Jan. 17, 2014; San Jose; (Motion Picture Expert Group or ISO/IEC JTC1/SC29/WG11), No. m31827, Jan. 11, 2014 (Jan. 11, 2014), 83 Pages, XP030060280.
Sen D., et al., "Technical Description of the Qualcomm's HoA Coding Technology for Phase II", 109. MPEG Meeting; Jul. 7, 2014-Nov. 7, 2014; Sapporo; (Motion Picture Expert Group or ISO/IEC JTC1/SC29/WG11), No. m34104, Jul. 2, 2014 (Jul. 2, 2014), XP030062477, figure 1, 4 pages.
"Text of ISO/IEC FDIS 23009-1:2014 4th edition", ISO/IEC JTC 1/SC 29/WG 11 N18609, Aug. 9, 2019 (Aug. 9, 2019), 389 Pages, Retrieved from the Internet: https://isotc.iso.org/livelink/livelink/open/jtc1sc29wg11.
International Standard ISO 12913-1: Acoustics—Soundscape—Part 1: Definition and Conceptual Framework:, First Edition, Sep. 1, 2014, 12 pages.
International Preliminary Report on Patentability—PCT/US2019/053837, The International Bureau of WIPO—Geneva, Switzerland, Apr. 15, 2021 11 Pages.

* cited by examiner

REPRESENTING OCCLUSION WHEN RENDERING FOR COMPUTER-MEDIATED REALITY SYSTEMS

This application claims the benefit of U.S. Provisional Ser. No. 62/740,085, entitled "REPRESENTING OCCLUSION WHEN RENDERING FO COMPUTER-MEDIATED REALITY SYSTEMS," filed Oct. 2, 2018, the entire contents of which are hereby incorporated by reference as if set forth in their entirety.

TECHNICAL FIELD

This disclosure relates to processing of media data, such as audio data.

BACKGROUND

Computer-mediated reality systems are being developed to allow computing devices to augment or add to, remove or subtract from, or generally modify existing reality experienced by a user. Computer-mediated reality systems may include, as a couple of examples, virtual reality (VR) systems, augmented reality (AR) systems, and mixed reality (MR) systems. The perceived success of computer-mediated reality systems are generally related to the ability of such computer-mediated reality systems to provide a realistically immersive experience in terms of both the video and audio experience where the video and audio experience align in ways expected by the user. Although the human visual system is more sensitive than the human auditory systems (e.g., in terms of perceived localization of various objects within the scene), ensuring a adequate auditory experience is an increasingly import factor in ensuring a realistically immersive experience, particularly as the video experience improves to permit better localization of video objects that enable the user to better identify sources of audio content.

SUMMARY

This disclosure relates generally to auditory aspects of the user experience of computer-mediated reality systems, including virtual reality (VR), mixed reality (MR), augmented reality (AR), and/or any other type of extended reality (XR), and in addition to computer vision, and graphics systems. The techniques may enable modeling of occlusions when rendering audio data for the computer-mediated reality systems. Rather than only account for reflections in a given virtual environment, the techniques may enable the computer-mediated reality systems to address occlusions that may prevent audio waves (which may also be referred to a "sound") represented by the audio data from propagating by various degrees throughout the virtual space. Furthermore, the techniques may enable different models based on different virtual environments, where for example a binaural room impulse response (BRIR) model may be used in virtual indoor environments, while a head related transfer function (HRTF) may be used in virtual outdoor environments.

In one example, the techniques are directed to a device comprising: a memory configured to store audio data representative of a soundfield; and one or more processors coupled to the memory, and configured to: obtain occlusion metadata representative of an occlusion within the soundfield in terms of propagation of sound through the occlusion, the occlusion separating the soundfield into two or more sound spaces; obtain a location of the device within the soundfield relative to the occlusion; obtain, based on the occlusion metadata and the location, a renderer by which to render the audio data into one or more speaker feeds that account for propagation of the sound in one of the two or more sound spaces in which the device resides; and apply the renderer to the audio data to generate the speaker feeds.

In another example, the techniques are directed to a method comprising: obtaining, by a device, occlusion metadata representative of an occlusion within a soundfield in terms of propagation of sound through the occlusion, the occlusion separating the soundfield into two or more sound spaces; obtaining, by the device, a location of the device within the soundfield relative to the occlusion; obtaining, by the device, based on the occlusion metadata and the location, a renderer by which to render audio data representative of the soundfield into one or more speaker feeds that account for propagation of the sound in one of the two or more sound spaces in which the device resides; and applying, by the device, the renderer to the audio data to generate the speaker feeds.

In another example, the techniques are directed to a device comprising: means for obtaining occlusion metadata representative of an occlusion within a soundfield in terms of propagation of sound through the occlusion, the occlusion separating the soundfield into two or more sound spaces; means for obtaining a location of the device within the soundfield relative to the occlusion; means for obtaining, based on the occlusion metadata and the location, a renderer by which to render audio data representative of the soundfield into one or more speaker feeds that account for propagation of the sound in one of the two or more sound spaces in which the device resides; and means for applying the renderer to the audio data to generate the speaker feeds.

In another example, the techniques are directed to a non-transitory computer-readable storage medium having stored thereon instructions that, when executed, cause one or more processors of a device to: obtain, occlusion metadata representative of an occlusion within a soundfield in terms of propagation of sound through the occlusion, the occlusion separating the soundfield into two or more sound spaces; obtain a location of the device within the soundfield relative to the occlusion; obtain, based on the occlusion metadata and the location, a renderer by which to render audio data representative of the soundfield into one or more speaker feeds that account for propagation of the sound in one of the two or more sound spaces in which the device resides; and apply the renderer to the audio data to generate the speaker feeds.

In another example, the techniques are directed to a device comprising: a memory configured to store audio data representative of a soundfield; and one or more processors coupled to the memory, and configured to: obtain occlusion metadata representative of an occlusion within the soundfield in terms of propagation of sound through the occlusion, the occlusion separating the soundfield into two or more sound spaces; specify, in a bitstream representative of the audio data, the occlusion metadata to enable a renderer to be obtained by which to render the audio data into one or more speaker feeds that account for propagation of the sound in one of the two or more sound spaces.

In another example, the techniques are directed to a method comprising: obtaining, by a device, occlusion metadata representative of an occlusion within a soundfield in terms of propagation of sound through the occlusion, the occlusion separating the soundfield into two or more sound spaces; specifying, by the device, in a bitstream representative of audio data descriptive of the soundfield, the occlusion metadata to enable a renderer to be obtained by which to render the audio data into one or more speaker feeds that account for propagation of the sound in one of the two or more sound spaces.

In another example, the techniques are directed to a device comprising: means for obtaining occlusion metadata representative of an occlusion within a soundfield in terms of propagation of sound through the occlusion, the occlusion separating the soundfield into two or more sound spaces; means for specifying, in a bitstream representative of audio data descriptive of the soundfield, the occlusion metadata to enable a renderer to be obtained by which to render the audio data into one or more speaker feeds that account for propagation of the sound in one of the two or more sound spaces.

In another example, the techniques are directed to a non-transitory computer-readable storage medium having stored thereon instructions that, when executed, cause one or more processors of a device to: obtain occlusion metadata representative of an occlusion within a soundfield in terms of propagation of sound through the occlusion, the occlusion separating the soundfield into two or more sound spaces; and specify, in a bitstream representative of audio data descriptive of the soundfield, the occlusion metadata to enable a renderer to be obtained by which to render the audio data into one or more speaker feeds that account for propagation of the sound in one of the two or more sound spaces.

The details of one or more examples of this disclosure are set forth in the accompanying drawings and the description below. Other features, objects, and advantages of various aspects of the techniques will be apparent from the description and drawings, and from the claims.

DETAILED DESCRIPTION

Figure 1A:
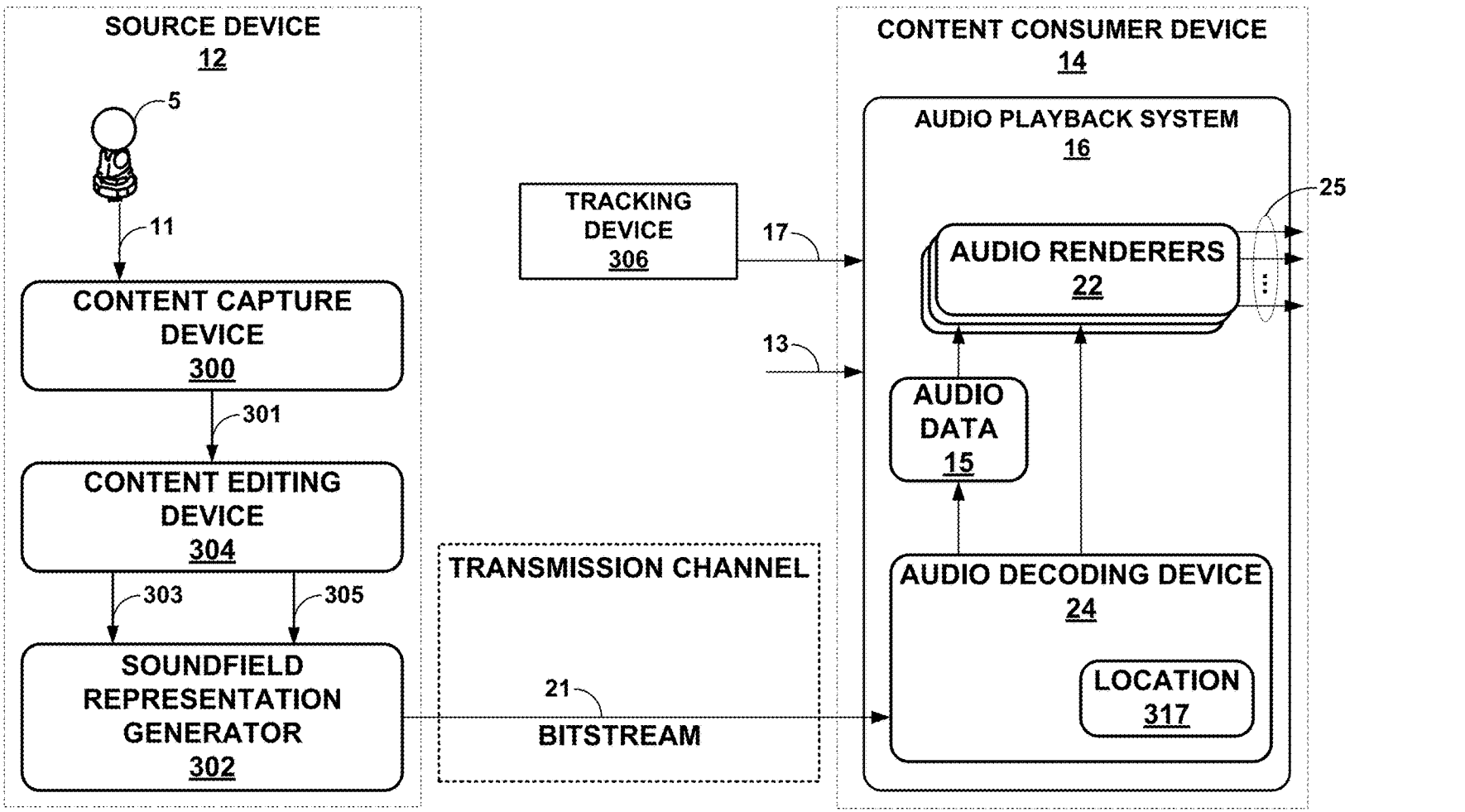
FIGS. 1A and 1B are diagrams illustrating systems that may perform various aspects of the techniques described in this disclosure.

There are a number of different ways to represent a soundfield. Example formats include channel-based audio formats, object-based audio formats, and scene-based audio formats. Channel-based audio formats refer to the 5.1 surround sound format, 7.1 surround sound formats, 22.2 surround sound formats, or any other channel-based format that localizes audio channels to particular locations around the listener in order to recreate a soundfield.

Object-based audio formats may refer to formats in which audio objects, often encoded using pulse-code modulation (PCM) and referred to as PCM audio objects, are specified in order to represent the soundfield. Such audio objects may include metadata identifying a location of the audio object relative to a listener or other point of reference in the soundfield, such that the audio object may be rendered to one or more speaker channels for playback in an effort to recreate the soundfield. The techniques described in this disclosure may apply to any of the foregoing formats, including scene-based audio formats, channel-based audio formats, object-based audio formats, or any combination thereof.

Scene-based audio formats may include a hierarchical set of elements that define the soundfield in three dimensions. One example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{\omega=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r, B_r, \varphi_r\}$ of the soundfield, at time t, can be represented uniquely by the SHC, $A_n^m(k)$. Here $$k = \frac{\omega}{c},$$

c is the speed of sound (~343 m/s), $\{r_r, \theta_r, \varphi_r\}$ is a point of reference (or observation point), $j_n(\cdot)$ is the spherical Bessel function of order n, and $Y_n^m(\theta_r, \varphi_r)$ are the spherical harmonic basis functions (which may also be referred to as a spherical basis function) of order n and suborder m. It can be recognized that the term in square brackets is a frequency-domain representation of the signal (i.e., $S(\omega, r_r, B_r, \varphi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

The SHC $A_n^m$ (k) can either be physically acquired (e.g., recorded) by various microphone array configurations or, alternatively, they can be derived from channel-based or object-based descriptions of the soundfield. The SHC (which also may be referred to as ambisonic coefficients) represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be physically acquired from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

The following equation may illustrate how the SHCs may be derived from an object-based description. The coefficients $A_n^m$ (k) for the soundfield corresponding to an individual audio object may be expressed as:

$$A_n^m(k) = g(\omega)(-4\pi ik)h_n^{(2)}(kr_s)Y_n^{m*}(\theta_s, \varphi_s),$$

where i is $\sqrt{-1}$, $h_n^{(2)}(\cdot)$ is the spherical Hankel function (of the second kind) of order n, and $\{r_s, \theta_s, \varphi_s\}$ is the location of the object. Knowing the object source energy $g(\omega)$ as a function of frequency (e.g., using time-frequency analysis techniques, such as performing a fast Fourier transform on the pulse code modulated—PCM—stream) may enable conversion of each PCM object and the corresponding location into the SHC $A_n^m(k)$ Further, it can be shown (since the above is a linear and orthogonal decomposition) that the $A_n^m$ (k) coefficients for each object are additive. In this manner, a number of PCM objects can be represented by the $A_n^m$ (k) coefficients (e.g., as a sum of the coefficient vectors for the individual objects). The coefficients may contain information about the soundfield (the pressure as a function of 3D coordinates), and the above represents the transformation from individual objects to a representation of the overall soundfield, in the vicinity of the observation point $\{r_r, \theta_r, \varphi_r\}$.

Computer-mediated reality systems (which may also be referred to as "extended reality systems," or "XR systems") are being developed to take advantage of many of the potential benefits provided by ambisonic coefficients. For example, ambisonic coefficients may represent a soundfield in three dimensions in a manner that potentially enables accurate three-dimensional (3D) localization of sound sources within the soundfield. As such, XR devices may render the ambisonic coefficients to speaker feeds that, when played via one or more speakers, accurately reproduce the soundfield.

The use of ambisonic coefficients for XR may enable development of a number of use cases that rely on the more immersive soundfields provided by the ambisonic coefficients, particularly for computer gaming applications and live video streaming applications. In these highly dynamic use cases that rely on low latency reproduction of the soundfield, the XR devices may prefer ambisonic coefficients over other representations that are more difficult to manipulate or involve complex rendering. More information regarding these use cases is provided below with respect to FIGS. 1A and 1B.

While described in this disclosure with respect to the VR device, various aspects of the techniques may be performed in the context of other devices, such as a mobile device. In this instance, the mobile device (such as a so-called smartphone) may present the displayed world via a screen, which may be mounted to the head of the user 102 or viewed as would be done when normally using the mobile device. As such, any information on the screen can be part of the mobile device. The mobile device may be able to provide tracking information 41 and thereby allow for both a VR experience (when head mounted) and a normal experience to view the displayed world, where the normal experience may still allow the user to view the displayed world proving a VR-lite-type experience (e.g., holding up the device and rotating or translating the device to view different portions of the displayed world).

Figure 1B:
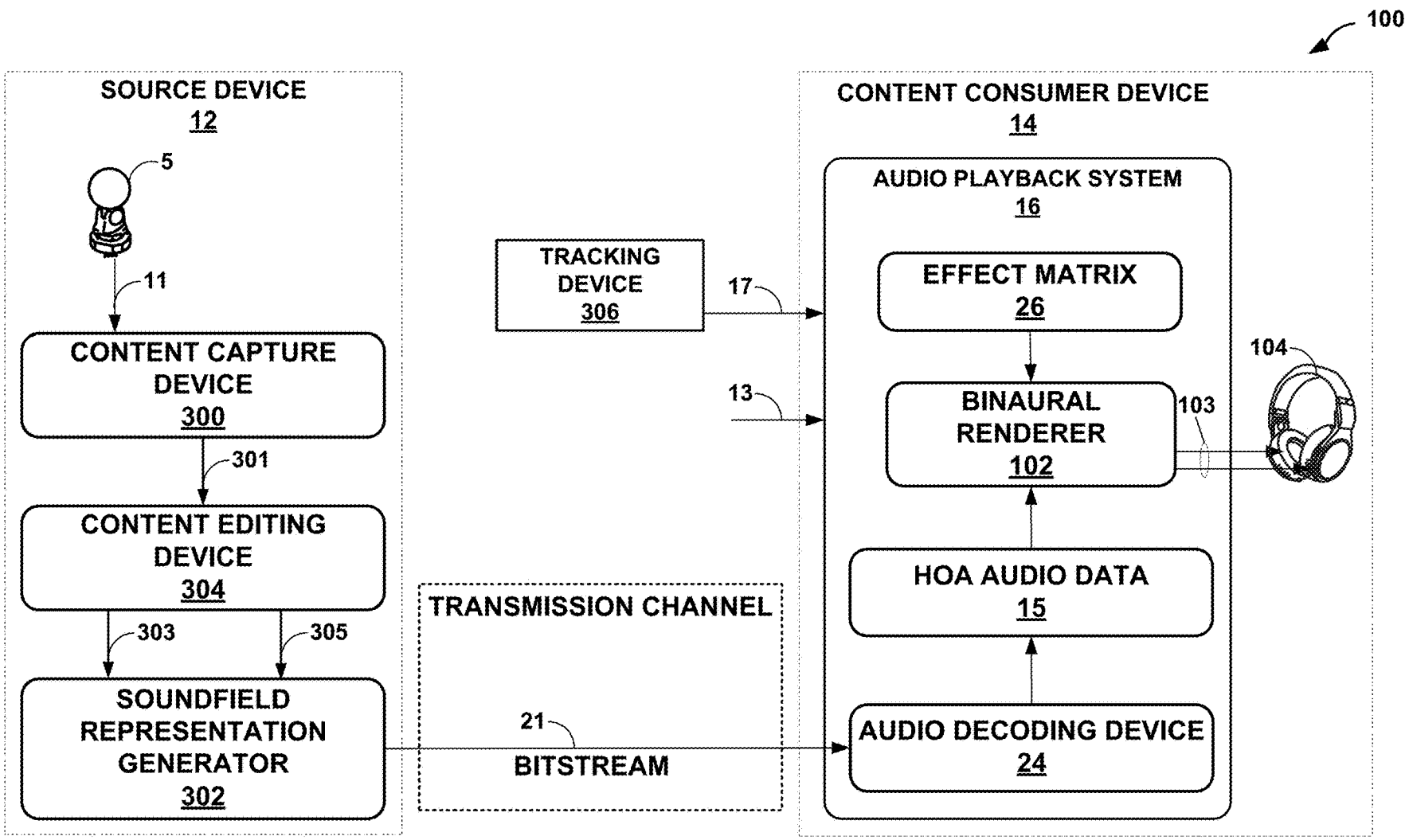

FIGS. 1A and 1B are diagrams illustrating systems that may perform various aspects of the techniques described in this disclosure. As shown in the example of FIG. 1A, system 10 includes a source device 12 and a content consumer device 14. While described in the context of the source device 12 and the content consumer device 14, the techniques may be implemented in any context in which any hierarchical representation of a soundfield is encoded to form a bitstream representative of the audio data. Moreover, the source device 12 may represent any form of computing device capable of generating hierarchical representation of a soundfield, and is generally described herein in the context of being a VR content creator device. Likewise, the content consumer device 14 may represent any form of computing device capable of implementing the audio stream interpolation techniques described in this disclosure as well as audio playback, and is generally described herein in the context of being a VR client device.

The source device 12 may be operated by an entertainment company or other entity that may generate multichannel audio content for consumption by operators of content consumer devices, such as the content consumer device 14. In many VR scenarios, the source device 12 generates audio content in conjunction with video content. The source device 12 includes a content capture device 300 and a content soundfield representation generator 302.

The content capture device 300 may be configured to interface or otherwise communicate with one or more microphones 5A-5N ("microphones 5"). The microphones 5 may represent an Eigenmike® or other type of 3D audio microphone capable of capturing and representing the soundfield as corresponding scene-based audio data 11A-11N (which may also be referred to as ambisonic coefficients 11A-11N or "ambisonic coefficients 11"). In the context of scene-based audio data 11 (which is another way to refer to the ambisonic coefficients 11"), each of the microphones 5 may represent a cluster of microphones arranged within a single housing according to set geometries that facilitate generation of the ambisonic coefficients 11. As such, the term microphone may refer to a cluster of microphones (which are actually geometrically arranged transducers) or a single microphone (which may be referred to as a spot microphone).

The ambisonic coefficients 11 may represent one example of an audio stream. As such, the ambisonic coefficients 11 may also be referred to as audio streams 11. Although described primarily with respect to the ambisonic coefficients 11, the techniques may be performed with respect to other types of audio streams, including pulse code modulated (PCM) audio streams, channel-based audio streams, object-based audio streams, etc.

The content capture device 300 may, in some examples, include an integrated microphone that is integrated into the housing of the content capture device 300. The content capture device 300 may interface wirelessly or via a wired connection with the microphones 5. Rather than capture, or in conjunction with capturing, audio data via the microphones 5, the content capture device 300 may process the ambisonic coefficients 11 after the ambisonic coefficients 11 are input via some type of removable storage, wirelessly, and/or via wired input processes, or alternatively or in conjunction with the foregoing, generated or otherwise created (from stored sound samples, such as is common in gaming applications, etc.). As such, various combinations of the content capture device 300 and the microphones 5 are possible.

The content capture device 300 may also be configured to interface or otherwise communicate with the soundfield representation generator 302. The soundfield representation generator 302 may include any type of hardware device capable of interfacing with the content capture device 300. The soundfield representation generator 302 may use the ambisonic coefficients 11 provided by the content capture device 300 to generate various representations of the same soundfield represented by the ambisonic coefficients 11.

For instance, to generate the different representations of the soundfield using ambisonic coefficients (which again is one example of the audio streams), the soundfield representation generator 24 may use a coding scheme for ambisonic representations of a soundfield, referred to as Mixed Order Ambisonics (MOA) as discussed in more detail in U.S. application Ser. No. 15/672,058, entitled "MIXED-ORDER AMBISONICS (MOA) AUDIO DATA FO COMPUTER-MEDIATED REALITY SYSTEMS," filed Aug. 8, 2017, and published as U.S. patent publication no. 20190007781 on Jan. 3, 2019.

To generate a particular MOA representation of the soundfield, the soundfield representation generator 24 may generate a partial subset of the full set of ambisonic coefficients. For instance, each MOA representation generated by the soundfield representation generator 24 may provide precision with respect to some areas of the soundfield, but less precision in other areas. In one example, an MOA representation of the soundfield may include eight (8) uncompressed ambisonic coefficients, while the third order ambisonic representation of the same soundfield may include sixteen (16) uncompressed ambisonic coefficients. As such, each MOA representation of the soundfield that is generated as a partial subset of the ambisonic coefficients may be less storage-intensive and less bandwidth intensive (if and when transmitted as part of the bitstream 27 over the illustrated transmission channel) than the corresponding third order ambisonic representation of the same soundfield generated from the ambisonic coefficients.

Although described with respect to MOA representations, the techniques of this disclosure may also be performed with respect to first-order ambisonic (FOA) representations in which all of the ambisonic coefficients associated with a first order spherical basis function and a zero order spherical basis function are used to represent the soundfield. In other words, rather than represent the soundfield using a partial, non-zero subset of the ambisonic coefficients, the soundfield representation generator 302 may represent the soundfield using all of the ambisonic coefficients for a given order N, resulting in a total of ambisonic coefficients equaling $(N+1)^2$.

In this respect, the ambisonic audio data (which is another way to refer to the ambisonic coefficients in either MOA representations or full order representations, such as the first-order representation noted above) may include ambisonic coefficients associated with spherical basis functions having an order of one or less (which may be referred to as "$1^{st}$ order ambisonic audio data"), ambisonic coefficients associated with spherical basis functions having a mixed order and suborder (which may be referred to as the "MOA representation" discussed above), or ambisonic coefficients associated with spherical basis functions having an order greater than one (which is referred to above as the "full order representation").

The content capture device 300 may, in some examples, be configured to wirelessly communicate with the soundfield representation generator 302. In some examples, the content capture device 300 may communicate, via one or both of a wireless connection or a wired connection, with the soundfield representation generator 302. Via the connection between the content capture device 300 and the soundfield representation generator 302, the content capture device 300 may provide content in various forms of content, which, for purposes of discussion, are described herein as being portions of the ambisonic coefficients 11.

In some examples, the content capture device 300 may leverage various aspects of the soundfield representation generator 302 (in terms of hardware or software capabilities of the soundfield representation generator 302). For example, the soundfield representation generator 302 may include dedicated hardware configured to (or specialized software that when executed causes one or more processors to) perform psychoacoustic audio encoding (such as a unified speech and audio coder denoted as "USAC" set forth by the Moving Picture Experts Group (MPEG), the MPEG-H 3D audio coding standard, the MPEG-I Immersive Audio standard, or proprietary standards, such as AptX™ (including various versions of AptX such as enhanced AptX-E-AptX, AptX live, AptX stereo, and AptX high definition—AptX-HD), advanced audio coding (AAC), Audio Codec 3 (AC-3), Apple Lossless Audio Codec (ALAC), MPEG-4 Audio Lossless Streaming (ALS), enhanced AC-3, Free Lossless Audio Codec (FLAC), Monkey's Audio, MPEG-1 Audio Layer II (MP2), MPEG-1 Audio Layer III (MP3), Opus, and Windows Media Audio (WMA).

The content capture device 300 may not include the psychoacoustic audio encoder dedicated hardware or specialized software and instead provide audio aspects of the content 301 in a non-psychoacoustic audio coded form. The soundfield representation generator 302 may assist in the capture of content 301 by, at least in part, performing psychoacoustic audio encoding with respect to the audio aspects of the content 301.

The soundfield representation generator 302 may also assist in content capture and transmission by generating one or more bitstreams 21 based, at least in part, on the audio content (e.g., MOA representations, third order ambisonic representations, and/or first order ambisonic representations) generated from the ambisonic coefficients 11. The bitstream 21 may represent a compressed version of the ambisonic coefficients 11 (and/or the partial subsets thereof used to form MOA representations of the soundfield) and any other different types of the content 301 (such as a compressed version of spherical video data, image data, or text data).

The soundfield representation generator 302 may generate the bitstream 21 for transmission, as one example, across a transmission channel, which may be a wired or wireless channel, a data storage device, or the like. The bitstream 21 may represent an encoded version of the ambisonic coefficients 11 (and/or the partial subsets thereof used to form MOA representations of the soundfield) and may include a primary bitstream and another side bitstream, which may be referred to as side channel information. In some instances, the bitstream 21 representing the compressed version of the ambisonic coefficients 11 may conform to bitstreams produced in accordance with the MPEG-H 3D audio coding standard.

The content consumer device 14 may be operated by an individual, and may represent a VR client device. Although described with respect to a VR client device, content consumer device 14 may represent other types of devices, such as an augmented reality (AR) client device, a mixed reality (MR) client device (or any other type of head-mounted display device or extended reality—XR— device), a standard computer, a headset, headphones, or any other device capable of tracking head movements and/or general translational movements of the individual operating the client consumer device 14. As shown in the example of FIG. 1A, the content consumer device 14 includes an audio playback system 16A, which may refer to any form of audio playback system capable of rendering ambisonic coefficients (whether in form of first order, second order, and/or third order ambisonic representations and/or MOA representations) for playback as multi-channel audio content.

The content consumer device 14 may retrieve the bitstream 21 directly from the source device 12. In some examples, the content consumer device 12 may interface with a network, including a fifth generation (5G) cellular network, to retrieve the bitstream 21 or otherwise cause the source device 12 to transmit the bitstream 21 to the content consumer device 14.

While shown in FIG. 1A as being directly transmitted to the content consumer device 14, the source device 12 may output the bitstream 21 to an intermediate device positioned between the source device 12 and the content consumer device 14. The intermediate device may store the bitstream 21 for later delivery to the content consumer device 14, which may request the bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer device 14, requesting the bitstream 21.

Alternatively, the source device 12 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to the channels by which content stored to the mediums are transmitted (and may include retail stores and other store-based delivery mechanism). In any event, the techniques of this disclosure should not therefore be limited in this respect to the example of FIG. 1A.

As noted above, the content consumer device 14 includes the audio playback system 16. The audio playback system 16 may represent any system capable of playing back multi-channel audio data. The audio playback system 16A may include a number of different audio renderers 22. The renderers 22 may each provide for a different form of audio rendering, where the different forms of rendering may include one or more of the various ways of performing vector-base amplitude panning (VBAP), and/or one or more of the various ways of performing soundfield synthesis. As used herein, "A and/or B" means "A or B", or both "A and B".

The audio playback system 16A may further include an audio decoding device 24. The audio decoding device 24 may represent a device configured to decode bitstream 21 to output reconstructed ambisonic coefficients 11A'-11N' (which may form the full first, second, and/or third order ambisonic representation or a subset thereof that forms an MOA representation of the same soundfield or decompositions thereof, such as the predominant audio signal, ambient ambisonic coefficients, and the vector based signal described in the MPEG-H 3D Audio Coding Standard and/or the MPEG-I Immersive Audio standard).

As such, the ambisonic coefficients 11A'-11N' ("ambisonic coefficients 11'") may be similar to a full set or a partial subset of the ambisonic coefficients 11, but may differ due to lossy operations (e.g., quantization) and/or transmission via the transmission channel. The audio playback system 16 may, after decoding the bitstream 21 to obtain the ambisonic coefficients 11', obtain ambisonic audio data 15 from the different streams of ambisonic coefficients 11', and render the ambisonic audio data 15 to output speaker feeds 25. The speaker feeds 25 may drive one or more speakers (which are not shown in the example of FIG. 1A for ease of illustration purposes). Ambisonic representations of a soundfield may be normalized in a number of ways, including N3D, SN3D, FuMa, N2D, or SN2D.

To select the appropriate renderer or, in some instances, generate an appropriate renderer, the audio playback system 16A may obtain loudspeaker information 13 indicative of a number of loudspeakers and/or a spatial geometry of the loudspeakers. In some instances, the audio playback system 16A may obtain the loudspeaker information 13 using a reference microphone and outputting a signal to activate (or, in other words, drive) the loudspeakers in such a manner as to dynamically determine, via the reference microphone, the loudspeaker information 13. In other instances, or in conjunction with the dynamic determination of the loudspeaker information 13, the audio playback system 16A may prompt a user to interface with the audio playback system 16A and input the loudspeaker information 13.

The audio playback system 16A may select one of the audio renderers 22 based on the loudspeaker information 13. In some instances, the audio playback system 16A may, when none of the audio renderers 22 are within some threshold similarity measure (in terms of the loudspeaker geometry) to the loudspeaker geometry specified in the loudspeaker information 13, generate the one of audio renderers 22 based on the loudspeaker information 13. The audio playback system 16A may, in some instances, generate one of the audio renderers 22 based on the loudspeaker information 13 without first attempting to select an existing one of the audio renderers 22.

When outputting the speaker feeds 25 to headphones, the audio playback system 16A may utilize one of the renderers 22 that provides for binaural rendering using head-related transfer functions (HRTF) or other functions capable of rendering to left and right speaker feeds 25 for headphone speaker playback. The terms "speakers" or "transducer" may generally refer to any speaker, including loudspeakers, headphone speakers, etc. One or more speakers may then playback the rendered speaker feeds 25.

Although described as rendering the speaker feeds 25 from the ambisonic audio data 15, reference to rendering of the speaker feeds 25 may refer to other types of rendering, such as rendering incorporated directly into the decoding of the ambisonic audio data 15 from the bitstream 21. An example of the alternative rendering can be found in Annex G of the MPEG-H 3D audio coding standard, where rendering occurs during the predominant signal formulation and the background signal formation prior to composition of the soundfield. As such, reference to rendering of the ambisonic audio data 15 should be understood to refer to both rendering of the actual ambisonic audio data 15 or decompositions or representations thereof of the ambisonic audio data 15 (such as the above noted predominant audio signal, the ambient ambisonic coefficients, and/or the vector-based signal—which may also be referred to as a V-vector).

Figure 9A:
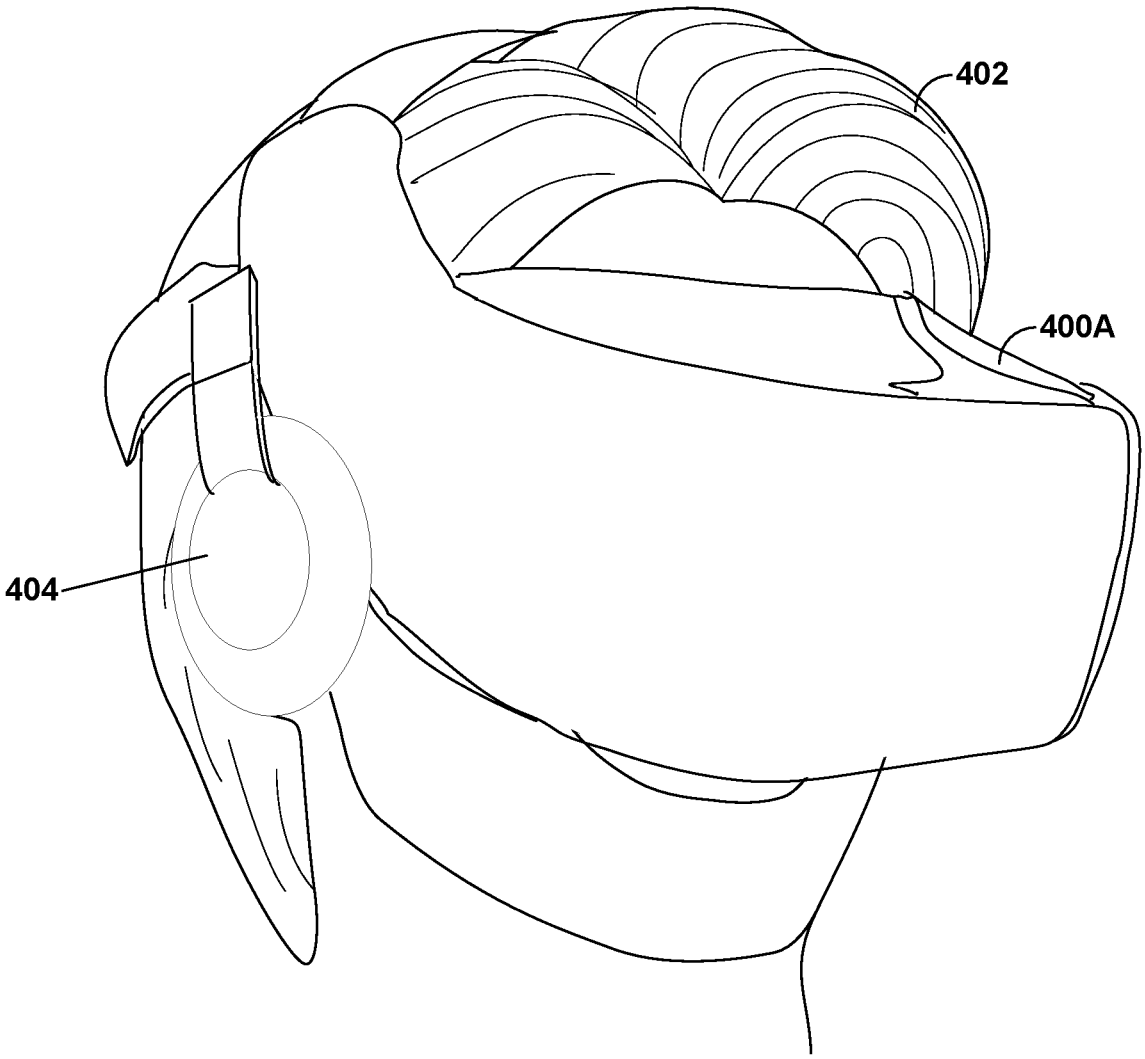
FIGS. 9A and 9B are diagrams illustrating example systems that may perform various aspects of the techniques described in this disclosure.
Figure 9B:
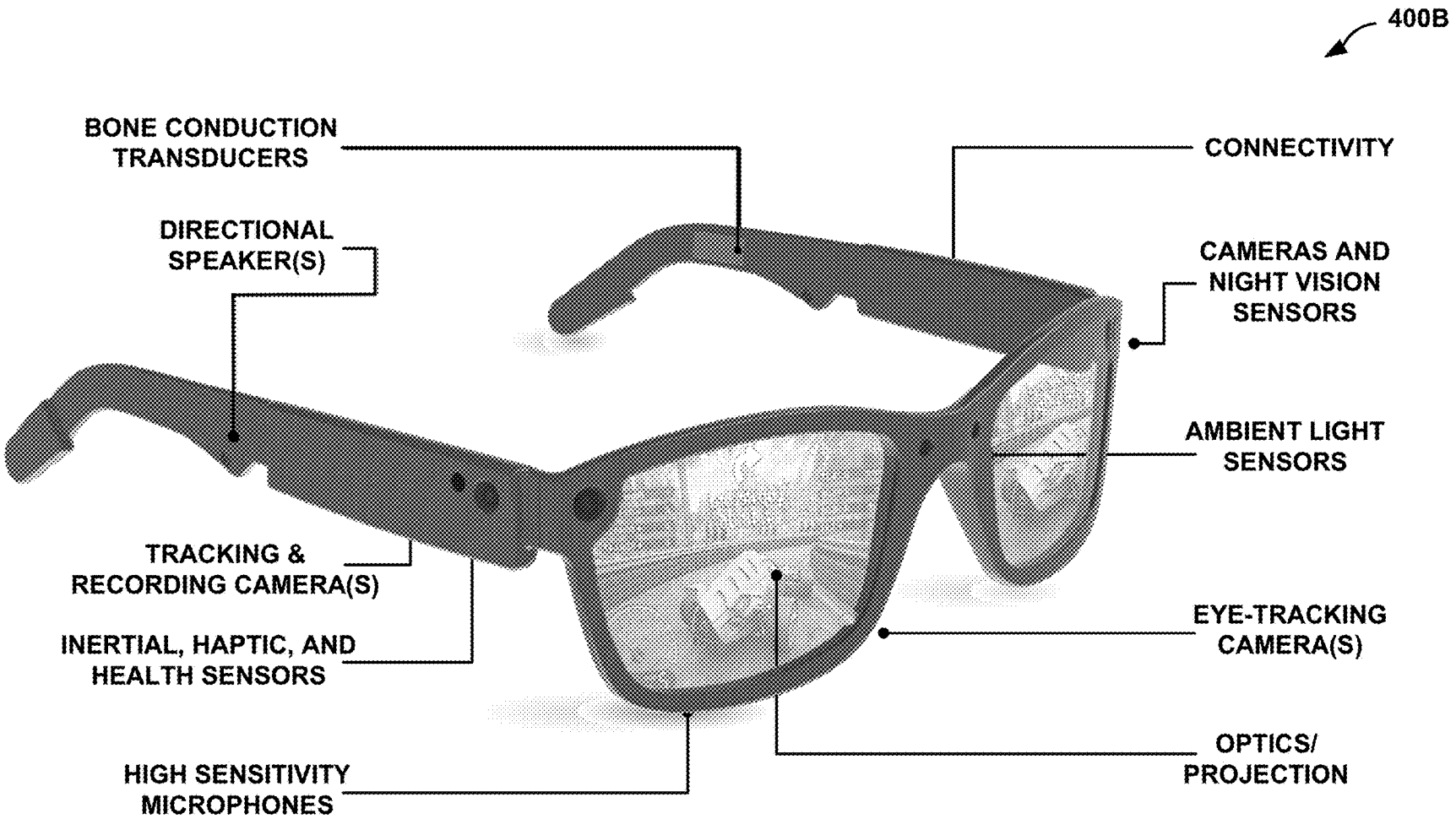

As described above, the content consumer device 14 may represent a VR device in which a human wearable display is mounted in front of the eyes of the user operating the VR device. FIGS. 9A and 9B are diagrams illustrating examples of VR devices 400A and 400B. In the example of FIG. 9A, the VR device 400A is coupled to, or otherwise includes, headphones 404, which may reproduce a soundfield represented by the ambisonic audio data 15 (which is another way to refer to ambisonic coefficients 15) through playback of the speaker feeds 25. The speaker feeds 25 may represent an analog or digital signal capable of causing a membrane within the transducers of headphones 404 to vibrate at various frequencies. Such a process is commonly referred to as driving the headphones 404.

Video, audio, and other sensory data may play important roles in the VR experience. To participate in a VR experience, a user 402 may wear the VR device 400A (which may also be referred to as a VR headset 400A) or other wearable electronic device. The VR client device (such as the VR headset 400A) may track head movement of the user 402, and adapt the video data shown via the VR headset 400A to account for the head movements, providing an immersive experience in which the user 402 may experience a virtual world shown in the video data in visual three dimensions.

While VR (and other forms of AR and/or MR, which may generally be referred to as a computer mediated reality device) may allow the user 402 to reside in the virtual world visually, often the VR headset 400A may lack the capability to place the user in the virtual world audibly. In other words, the VR system (which may include a computer responsible for rendering the video data and audio data—that is not shown in the example of FIG. 9A for ease of illustration purposes, and the VR headset 400A) may be unable to support full three dimension immersion audibly.

FIG. 9B is a diagram illustrating an example of a wearable device 400B that may operate in accordance with various aspect of the techniques described in this disclosure. In various examples, the wearable device 400B may represent a VR headset (such as the VR headset 400A described above), an AR headset, an MR headset, or any other type of XR headset. Augmented Reality "AR" may refer to computer rendered image or data that is overlaid over the real world where the user is actually located. Mixed Reality "MR" may refer to computer rendered image or data that is world locked to a particular location in the real world, or may refer to a variant on VR in which part computer rendered 3D elements and part photographed real elements are combined into an immersive experience that simulates the user's physical presence in the environment. Extended Reality "XR" may represent a catchall term for VR, AR, and MR. More information regarding terminology for XR can be found in a document by Jason Peterson, entitled "Virtual Reality, Augmented Reality, and Mixed Reality Definitions," and dated Jul. 7, 2017.

The wearable device 400B may represent other types of devices, such as a watch (including so-called "smart watches"), glasses (including so-called "smart glasses"), headphones (including so-called "wireless headphones" and "smart headphones"), smart clothing, smart jewelry, and the like. Whether representative of a VR device, a watch, glasses, and/or headphones, the wearable device 400B may communicate with the computing device supporting the wearable device 400B via a wired connection or a wireless connection.

In some instances, the computing device supporting the wearable device 400B may be integrated within the wearable device 400B and as such, the wearable device 400B may be considered as the same device as the computing device supporting the wearable device 400B. In other instances, the wearable device 400B may communicate with a separate computing device that may support the wearable device 400B. In this respect, the term "supporting" should not be understood to require a separate dedicated device but that one or more processors configured to perform various aspects of the techniques described in this disclosure may be integrated within the wearable device 400B or integrated within a computing device separate from the wearable device 400B.

For example, when the wearable device 400B represents an example of the VR device 400B, a separate dedicated computing device (such as a personal computer including the one or more processors) may render the audio and visual content, while the wearable device 400B may determine the translational head movement upon which the dedicated computing device may render, based on the translational head movement, the audio content (as the speaker feeds) in accordance with various aspects of the techniques described in this disclosure. As another example, when the wearable device 400B represents smart glasses, the wearable device 400B may include the one or more processors that both determine the translational head movement (by interfacing within one or more sensors of the wearable device 400B) and render, based on the determined translational head movement, the speaker feeds.

As shown, the wearable device 400B includes one or more directional speakers, and one or more tracking and/or recording cameras. In addition, the wearable device 400B includes one or more inertial, haptic, and/or health sensors, one or more eye-tracking cameras, one or more high sensitivity audio microphones, and optics/projection hardware. The optics/projection hardware of the wearable device 400B may include durable semi-transparent display technology and hardware.

The wearable device 400B also includes connectivity hardware, which may represent one or more network interfaces that support multimode connectivity, such as 4G communications, 5G communications, Bluetooth, etc. The wearable device 400B also includes one or more ambient light sensors, and bone conduction transducers. In some instances, the wearable device 400B may also include one or more passive and/or active cameras with fisheye lenses and/or telephoto lenses. Although not shown in FIG. 5B, the wearable device 400B also may include one or more light emitting diode (LED) lights. In some examples, the LED light(s) may be referred to as "ultra bright" LED light(s). The wearable device 400B also may include one or more rear cameras in some implementations. It will be appreciated that the wearable device 400B may exhibit a variety of different form factors.

Furthermore, the tracking and recording cameras and other sensors may facilitate the determination of translational distance. Although not shown in the example of FIG. 9B, wearable device 400B may include other types of sensors for detecting translational distance.

Although described with respect to particular examples of wearable devices, such as the VR device 400B discussed above with respect to the examples of FIG. 9B and other devices set forth in the examples of FIGS. 1A and 1B, a person of ordinary skill in the art would appreciate that descriptions related to FIGS. 1A-1B may apply to other examples of wearable devices. For example, other wearable devices, such as smart glasses, may include sensors by which to obtain translational head movements. As another example, other wearable devices, such as a smart watch, may include sensors by which to obtain translational movements. As such, the techniques described in this disclosure should not be limited to a particular type of wearable device, but any wearable device may be configured to perform the techniques described in this disclosure.

In any event, the audio aspects of VR have been classified into three separate categories of immersion. The first category provides the lowest level of immersion, and is referred to as three degrees of freedom (3DOF). 3DOF refers to audio rendering that accounts for movement of the head in the three degrees of freedom (yaw, pitch, and roll), thereby allowing the user to freely look around in any direction. 3DOF, however, cannot account for translational head movements in which the head is not centered on the optical and acoustical center of the soundfield.

The second category, referred to 3DOF plus (3DOF+), provides for the three degrees of freedom (yaw, pitch, and roll) in addition to limited spatial translational movements due to the head movements away from the optical center and acoustical center within the soundfield. 3DOF+ may provide support for perceptual effects such as motion parallax, which may strengthen the sense of immersion.

The third category, referred to as six degrees of freedom (6DOF), renders audio data in a manner that accounts for the three degrees of freedom in term of head movements (yaw, pitch, and roll) but also accounts for translation of the user in space (x, y, and z translations). The spatial translations may be induced by sensors tracking the location of the user in the physical world or by way of an input controller.

3DOF rendering is the current state of the art for audio aspects of VR. As such, the audio aspects of VR are less immersive than the video aspects, thereby potentially reducing the overall immersion experienced by the user, and introducing localization errors (e.g., such as when the auditory playback does not match or correlate exactly to the visual scene).

Furthermore, how sound is modeled in relation to the virtual environment is still being developed to enable more realistic sound propagation when various environmental objects may impact propagation of sound within the virtual environment. As such, audio immersion may be degraded when sounds appear to propagate through the virtual environment in ways that do not accurately reflect when the user of the VR headset 400 expects when confronted with real environments having similar geometries and objects. As one example, a common VR audio software developers kit may only permit for modeling of direct reflections of sounds off of objects (which may also be referred to as "occlusions"), such as walls, doors (where the occlusion metadata 305 for a door and other movable physical—virtually—occlusions may change as a result of the door being in different states of openness or closedness), etc. that separate the soundfield into two or more sound spaces, and do not account for how sound may propagate through such objects, reducing audio immersion who expects loud sounds (such as a gunshot, a scream, a helicopter, etc.) to propagate through some objects like walls and doors.

In accordance with the techniques described in this disclosure, the source device 12 may obtain occlusion metadata (which may represent a portion of the metadata 305, and as such may be referred to as "occlusion metadata 305") representative of an occlusion within the soundfield (represented by the edited audio data, which may form a portion of edited content 303 and as such may be denoted "edited audio data 305") in terms of propagation of sound through the occlusion. An audio editor may, when editing audio data 301 and in some examples, specify the occlusion metadata 305.

Alternatively or in combination with manual entry of occlusion metadata 305, the content editing device may automatically generate the occlusion metadata 305 (e.g., via software that, when executed, configures the content editor device 304 to automatically generate the occlusion metadata 305). In some instances, the audio editor may identify the occlusions and the content editor device 304 may automatically associate pre-defined occlusion metadata 305 with the manually identified occlusion. In any event, the content editor device 304 may obtain the occlusion metadata 305 and provide the occlusion metadata 305 to the soundfield representation generator 302.

The soundfield representation generator 302 may represent one example of a device or other unit configured to specify, in the audio bitstream 21 representative of the edited audio content 303 (which may refer to one of the one or more bitstreams 21), the occlusion metadata 305 to enable a renderer 22 to be obtained (by, e.g., the audio playback system 16) by which to render the edited audio content 303 into one or more speaker feeds 25 to model (or in other words, take into account of) how the sound propagates in one of two or more sound spaces separated by the occlusion (or, in slightly different words, that account for the propagation of sound in one of the two or more sound spaces separated by the occlusion).

The audio decoding device 24 may obtain, in some examples from the audio bitstream 21, the occlusion metadata 305 representative of the occlusion within the soundfield in terms of propagation of sound through the occlusion, where again the occlusion may separate the soundfield into two or more sound spaces. The audio decoding device 24 may also obtain a location 17 of the device (which in this instance may refer to the audio playback system 16 of which one example is the VR device) within the soundfield relative to the occlusion.

That is, the audio playback system 16 may interface with a tracking device 306, which represents a device configured to obtain the location 17 of the device. The audio playback system 16 may translate the physical location 17 within an actual space into a location within the virtual environment, and identify a location 317 of the audio playback system 16 relative to the location of the occlusion. The audio playback system 16 may obtain, based on the occlusion metadata 305 and the location 317, an occlusion-aware renderer of the renderers 22 by which to render the audio data 15 into one or more speaker feeds to model how the sound propagates in one of the two or more sound spaces in which the audio playback system 16 resides. The audio playback system 16 may then apply the occlusion-aware renderer (which may be denoted as "occlusion-aware renderer 22") to generate the speaker feeds 25.

The occlusion metadata 305 may include any combination of a number of different types of metadata, including one or more of a volume attenuation factor, a direct path only indication, a low pass filter description, and an indication of the location of the occlusion. The volume attenuation factor may be representative of an amount of volume associated with the audio data 15 is reduced while passing through the occlusion. The direct path only indication may be representative of whether a direct path exists for the audio data 15 or reverberation processing is to be applied (via the occlusion-aware renderer 22) to the audio data 15. The low pass filter description may be representative of coefficients to describe a low pass filter or a parametric description of the low pass filter (as integrated into or applied along with the occlusion-aware renderer 22).

The audio decoding device 24 may utilize the occlusion metadata 305 to generate the occlusion-aware renderer 22 that mixes live, prerecorded and synthetic audio content for 3DOF or 6DOF rendering. The occlusion metadata 305 may define information of occlusion acoustic characteristics that enables the audio decoding device 24 to identify how the sound spaces interact. In other words, the occlusion metadata 305 may define boundaries of the sound space, diffraction (or in other words shadowing) relative to the occlusion, absorption (or in other words leakage) relative to the occlusion, and an environment in which the occlusion is located.

The audio decoding device 24 may utilize the occlusion metadata 305 in any number of ways to generate the occlusion-aware renderer 22. For example, the audio decoding device 24 may utilize the occlusion metadata 305 as inputs to discrete mathematical equations. As another example, the audio decoding device 24 may utilize the occlusion metadata 305 as inputs to empirically derived filters. As yet another example, the audio decoding device 24 may utilize the occlusion metadata 305 as inputs to machine learning algorithms used to match the effects of the sound spaces. The audio decoding device 24 may also, in some examples, utilize any combination of the foregoing examples to generate the occlusion-aware renderer 22, including allowing for manual intervention to override the foregoing examples (such as for artistic purposes). An example of how various aspects of the techniques described in this disclosure may be applied to potentially improve rendering of audio data to account for occlusions and increase audio immersion is further described with respect to the example of FIG. 2.

Figure 2:
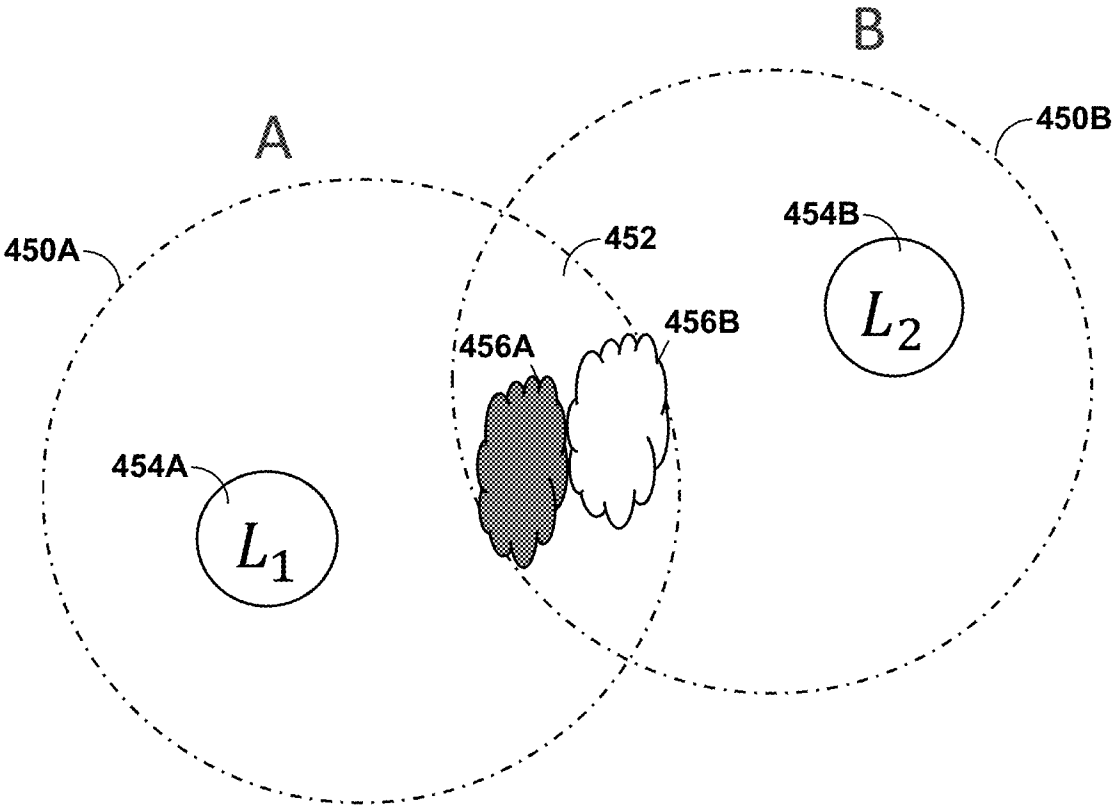
FIG. 2 is a block diagram illustrating an example of how the audio decoding device of FIG. 1A may apply various aspects of the techniques to facilitate occlusion aware rendering of audio data.

Although described with respect to a VR device as shown in the example of FIG. 2, the techniques may be performed by other types of wearable devices, including watches (such as so-called "smart watches"), glasses (such as so-called "smart glasses"), headphones (including wireless headphones coupled via a wireless connection, or smart headphones coupled via wired or wireless connection), and any other type of wearable device. As such, the techniques may be performed by any type of wearable device by which a user may interact with the wearable device while worn by the user.

Figure 3:
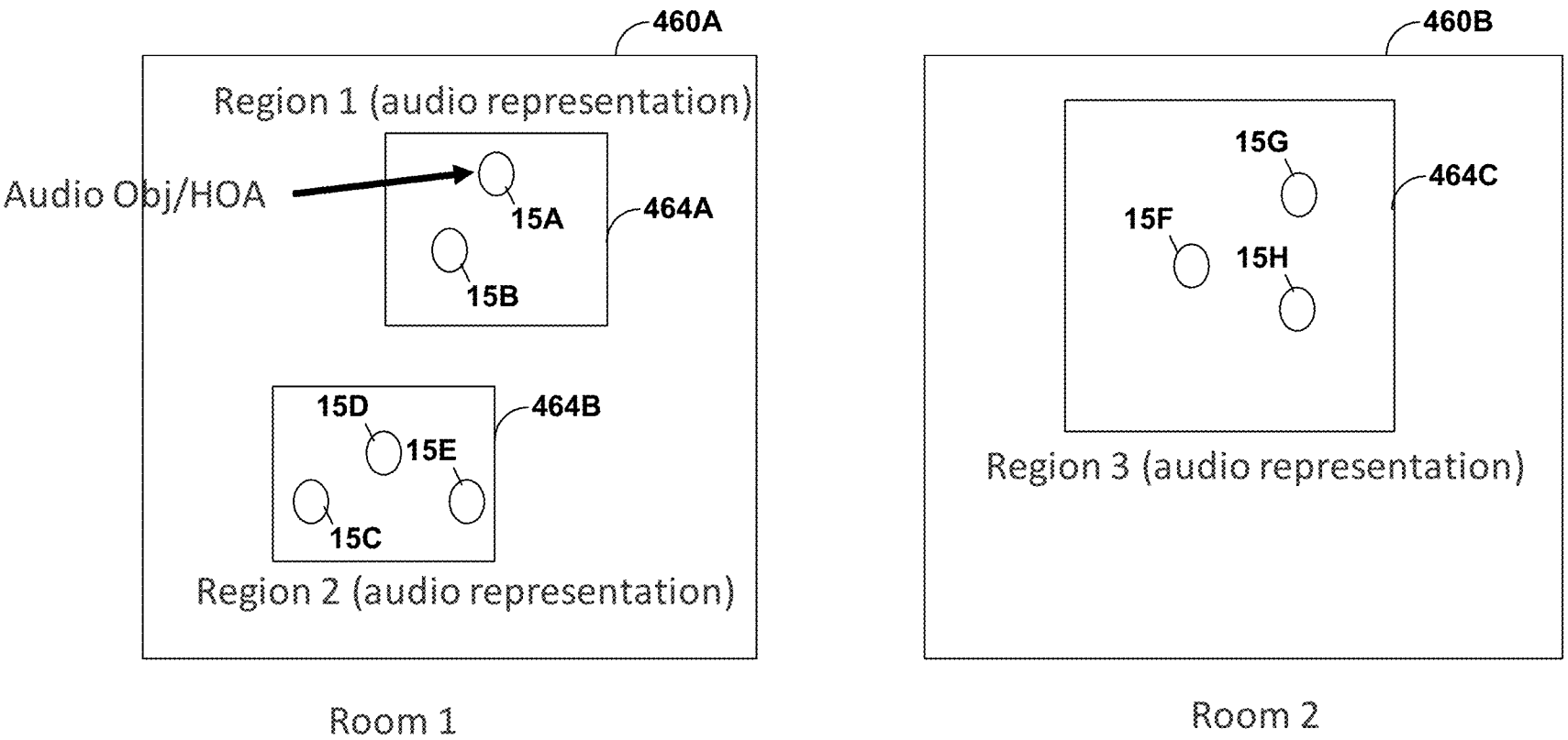
FIG. 3 is a block diagram illustrating another example how the audio decoding device of FIG. 1A may apply various aspects of the techniques to facilitate occlusion aware rendering of audio data.

FIG. 2 is a block diagram illustrating an example of how the audio decoding device of FIG. 1A may apply various aspects of the techniques to facilitate occlusion aware rendering of audio data. In the example of FIG. 3, the audio decoding device 24 may obtain the audio data 15 representative of two soundfields 450A and 450B, which overlap at portion 452. When multiple soundfields 450A and 450B overlap, the audio decoding device 24 may obtain occlusion metadata 305 that identifies that the boundaries of the soundfields 450A and 450B overlap and to what extent one of the soundfields 450A and 450B may occlude the other one of the soundfields 450A and 450B.

More specifically, when the location 317 indicates that the audio playback system 16 is located at location 454A (denoted "$L_1$"), the audio decoding device 24 may determine that part of the soundfield 450A is occluded by a part of the soundfield 450B, and generate the occlusion-aware renderer 22 to account for the occlusion. When the location 317 indicates that the audio playback system 16 is located at location 404B (denoted "$L_2$"), the audio decoding device 24 may determine that part of the soundfield 450B is occluded by a part of the soundfield 450A, and generate the occlusion-aware renderer 22 to account for the occlusion.

In the example of FIG. 2, the overlap portion 452 of soundfields 450A and 450B includes two sound spaces 456A and 456B. The occlusion metadata 305 may include a sound space boundary for each of the two sound spaces 456A and 456B, which may enable the audio decoding device 24 to obtain the occlusion-aware renderer 22 that potentially reflects the extent of the occlusion due to the overlap of the two soundfields 450A and 450B. As such, the occlusion may also refer to overlapping soundfields 450A and 450B in addition to referring to virtual objects that may obstruct the propagation of sound. The occlusion may, as a result, refer to any physical interaction (which in the example of FIG. 2 refers to the interaction of sound waves) that impacts the propagation of sound.

The occlusion metadata 305 may also include how to transition occlusion-aware rendering when the user of the audio playback system 16 moves within the soundfields 450A and 450B. For example, the audio decoding device 24 may obtain, based on the occlusion metadata 305, the occlusion-aware renderer 22 that transitions background components of the audio data 15 to foreground components when the location 317 of the user of the audio playback system 16 moves toward the edge of the portion 452.

The occlusion metadata 305 may also include, as noted above, an indication of the occlusion such that the audio decoding device 24 may obtain a distance of the occlusion (e.g., the portion 452) relative to the location 317 of the audio playback system 16. When the soundfield is occluded from a significant distance (e.g., such as above some threshold distance), the audio decoding device 24 may generate the occlusion-aware renderer 22 to model the occlusion as a mono source, which is then rendered according the occlusion-aware renderer. As an example, assume that the location 317 indicates that the audio playback system 16 is located at location 454A and there is a barrier between locations 454A and 454B (denoted "$L_2$", the audio decoding device 24 may generate the occlusion-aware renderer 22 to model the soundfield 450B as an occluded point source. Further information regarding how occlusion-aware rendering is performed when two soundfields interact is described with respect to FIG. 3.

FIG. 3 is a block diagram illustrating another example how the audio decoding device of FIG. 1A may apply various aspects of the techniques to facilitate occlusion aware rendering of audio data. In the example of FIG. 3, the audio decoding device 24 may obtain the audio data 15 representative of two soundfields 460A and 460B defined by the audio data 15A-15E and 15F-15H. As further shown in the example of FIG. 3, soundfield 460A includes two regions 464A and 464B represented by the audio data 15A-15B and 15C-15E, and soundfield 460B includes a single region 464C represented by the audio data 15F-15H.

Assume a scenario in which the user is able to move from the soundfield 460A to the soundfield 460B (or vice versa from the soundfield 460B to the soundfield 460A). In this scenario, the audio decoding device 24 may obtain occlusion metadata 305 that indicates whether or not sounds from the soundfield 460A may be heard in (or, in other words, propagates to) the soundfield 460B (and vice versa from the soundfield 460B may be heard in the soundfield 460A). The occlusion metadata 305 may in this respect differentiate between two different soundfields 460A and 460B.

Further, the audio decoding device 24 may receive the audio data 15A-15G grouped by each of regions 464A-464C. The content editing device 304 may associate different portions of the occlusion metadata 305 with each of the regions 464A-464C (or, in other words, with multiple audio data—e.g., a first portion of the occlusion metadata 305 with the audio data 15A-15B, a second portion of the occlusion metadata 305 with 15C-15E, and a third portion of the occlusion metadata 305 with 15F-15G). The association of different portions of the occlusion metadata 305 with each of the regions 464A-464C may promote more efficient transmission of the occlusion metadata 305 as less occlusion metadata may be sent, promoting more compact bitstreams that reduce memory and bandwidth consumption and processing cycles when generating the audio bitstream 21.

In this way, the audio decoding device 24 may obtain, based on the occlusion metadata 305 and the location 317, a first renderer for different sets of audio data (such as a group of audio objects—e.g., audio objects 15A and 15B), and apply the first renderer to the first group of audio objects to obtain first speaker feeds. The audio decoding device 24 may next obtain, based on the occlusion metadata 305 and the location 317, a second renderer for a second group of audio objects 15F-15H, and apply the second renderer to the second group of objects to obtain second speaker feeds. The audio decoding device 24 may then obtain, based on the first speaker feeds and the second speaker feeds, the speaker feeds. More information regarding how physical occlusions, like a wall, may be defined via the occlusion metadata 305 is provided below with respect to the example of FIG. 4.

Figure 4:
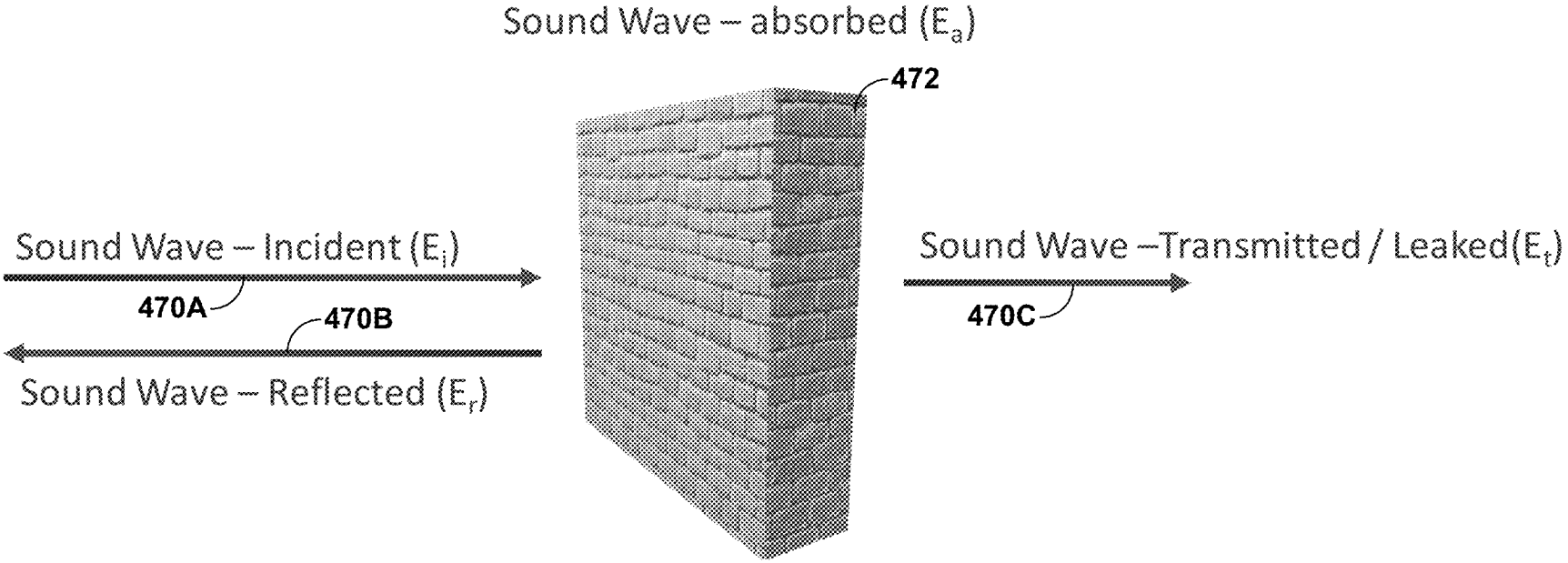
FIG. 4 is a block diagram illustrating an example occlusion and the accompanying occlusion metadata that may be provided in accordance with various aspects of the techniques described in this disclosure.

FIG. 4 is a block diagram illustrating an example occlusion and the accompanying occlusion metadata that may be provided in accordance with various aspects of the techniques described in this disclosure. As shown in the example of FIG. 4, an incident sound energy 470A (which may be denoted mathematically by the variable $E_i$) represented by the audio data 15 may encounter an occlusion 472 (shown as a wall, which is one example of a physical occlusion).

In response to determining that the incident sound energy 470A interacts with the occlusion 472, the audio decoding device 24 may obtain, based on the occlusion metadata 305, a reflected sound energy 470B (which may be denoted mathematically by the variable Er) and a transmitted (or, in other words, leaked) sound energy 470C (which may be denoted mathematically by the variable Et). The audio decoding device 24 may determine an absorbed or transmitted sound energy (denoted mathematically by the variable Eat) according to the following equation:

$$E_{at}=E_a+E_t,$$

where Ea refers to an absorbed sound energy. The occlusion metadata 305 may define an absorption coefficient for the occlusion 472, which may be denoted mathematically by the variable α. The absorption coefficient may be determined mathematically according to the following equation:

$$\alpha = \frac{E_{at}}{E_i},$$

where α=1 may denote 100% absorption and α=0 may denote 0% absorption (or, in other words, fully reflective).

The amount of sound energy absorbed depends on a type of material of the occlusion 472, a weight and/or density of the occlusion 472, and a thickness of the occlusion 472, which in turn may have an influence on a frequency of the incident sound wave. The occlusion metadata 305 may specify the absorption coefficient and sound leakage generally or for particular frequencies or frequency ranges. The following tables provide one example of the absorption coefficient for different materials and different frequencies.

| | 125 Hz | 500 Hz | 4 KHz |
|---|---|---|---|
| Material absorption α | | | |
| Brick/concrete | 0.01 | 0.02 | 0.02 |
| Plasterboard wall | 0.3 | 0.06 | 0.04 |
| Fiberglass board 25 mm 1 in | 0.2 | 0.1 | 0.1 |
| Material leakage x of α | | | |
| Brick/concrete | 0.01 x | 0.02 x | 0.02 x |
| Plasterboard wall | 0.3 x | 0.06 x | 0.04 x |
| Fiberglass board 25 mm 1 in | 0.2 x | 0.1 x | 0.1 x |

More information regarding various absorption coefficients and other occlusion metadata 305 and how this occlusion metadata 305 may be used to model occlusions can be found in an a book by Marshall Long, entitled "Architectural Acoustics," and published in 2014.

Figure 5:
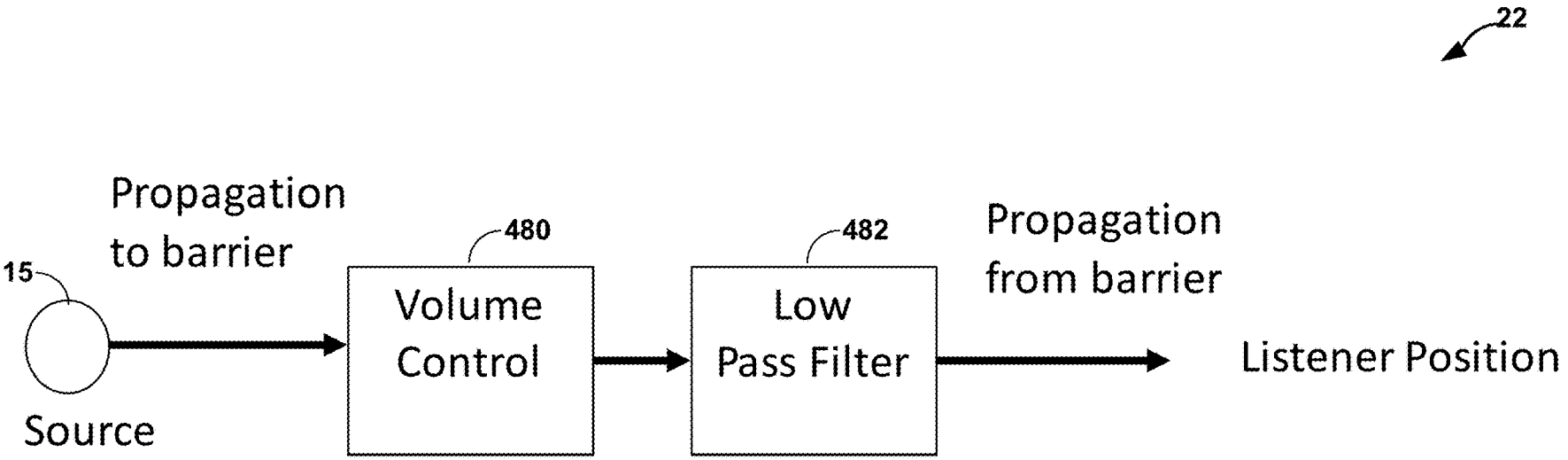
FIG. 5 is a block diagram illustrating an example of an occlusion aware renderer that the audio decoding device of FIG. 1A may configure based on the occlusion metadata.

FIG. 5 is a block diagram illustrating an example of an occlusion aware renderer that the audio decoding device of FIG. 1A may configure based on the occlusion metadata. In the example of FIG. 5, the occlusion aware renderer 22 may include a volume control unit 480 and a low pass filter unit 482 (which may be implemented mathematically as a single rendering matrix but is shown in decomposed form for purposes of discussion).

The volume control unit 480 may apply the volume attenuation factor (specified in the occlusion metadata 305 as noted above) to attenuate the volume (or, in other ways, gain) of the audio data 15. The audio decoding device 24 may configure the low pass filter unit 482 based on a low pass filter description, which may be retrieved based on the barrier material metadata (specified in the occlusion metadata 305 as described above). The low pass filter description may include coefficients to describe the low pass filter or a parametric description of the low pass filter.

The audio decoding device 24 may also configure the occlusion aware renderer 22 based on an indication of a direct path only, which may refer to whether the occlusion aware renderer 22 is applied directly or after reverberation processing. The audio decoding device 24 may obtain the indication of the direct path only based on environmental metadata that indicates an environment of the sound space in which the audio playback system 16 is located. The environment may indicate whether the user is located indoors or outdoors, a size of the environment or other geometry information of the environment, a medium (such as air or water), etc.

When the environment is indicated as being indoors, the audio decoding device 24 may obtain the indication of the direct path only to be false as rendering should proceed after performing reverberation processing to account for the indoor environment. When the environment is indicated as being outdoors, the audio decoding device 24 may obtain the indication of the direct path only to be true as rendering is configured to proceed directly (given that there is no or limited reverberation in outdoor environments).

As such, the audio decoding device 24 may obtain environment metadata describing the virtual environment in which the audio playback system 16 resides. The audio decoding device 24 may then obtain, based on the occlusion metadata 305, the environment metadata (which in some examples is separate from the occlusion metadata 305 although described above as being included in the occlusion metadata 305), and the location 317, the occlusion aware renderer 22. The audio decoding device 24 may obtain, when the environment metadata describes a virtual indoor environment, and based on the occlusion metadata 305 and the location 317, a binaural room impulse response renderer 22. The audio decoding device 24 may obtain, when the environment metadata describes the virtual outdoor environment, and based on the occlusion metadata 305 and the location 317, a head related transfer function renderer 22.

Figure 6:
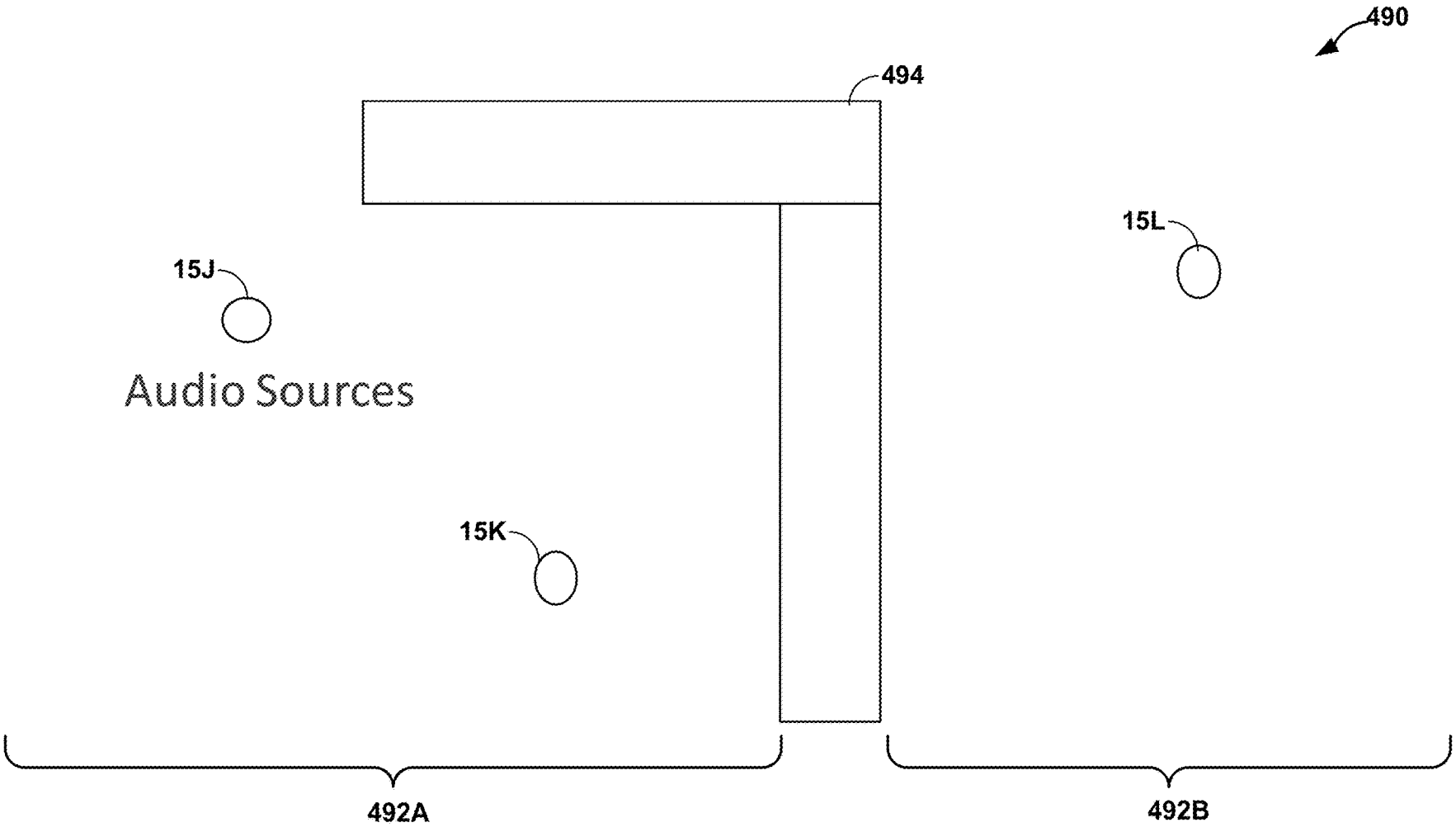
FIG. 6 is a block diagram illustrating how the audio decoding device of FIG. 1A may obtain, in accordance with various aspects of the techniques described in this disclosure, a renderer when an occlusion separates the soundfield into two sound spaces.

FIG. 6 is a block diagram illustrating how the audio decoding device of FIG. 1A may obtain, in accordance with various aspects of the techniques described in this disclosure, a renderer when an occlusion separates the soundfield into two sound spaces. Similar to the example of FIGS. 3 and 5, the soundfield 490 shown in the example of FIG. 6 is separated into two sound spaces 492A and 492B by an occlusion 494. The audio decoding device 24 may obtain occlusion metadata 305 describing the occlusion 494 (such as a volume and location of the barrier).

Based on the occlusion metadata 305, the audio decoding device 24 may determine a first renderer 22A for sound space 492 and a second renderer 22B for sound space 492B. The audio decoding device 24 may apply the first renderer 22A an audio data 15L in the sound space 492B to determine how much of the audio data 15L should be heard in the sound space 492A. The audio decoding device 24 may apply the second renderer 22B an audio data 15J and 15K in the sound space 492A to determine how much of the audio data 15J and 15K should be heard in the sound space 492B.

In this respect, the audio decoding device 24 may obtain a first renderer by which to render at least a first portion of the audio data into one or more first speaker feeds to model how the sound propagates in the first sound space, and obtain a second renderer by which to render at least a second portion of the audio data into one or more second speaker feeds to model how the sound propagates in the second sound space.

The audio decoding device 24 may apply the first renderer 22A to the first portion of the audio data 15L to generate the first speaker feeds, and apply the second renderer 22B to the second portion of the audio data 15J and 15K to generate the second speaker feeds. The audio decoding device 24 may next obtain, based on the first speaker feeds and the second speaker feeds, the speaker feeds 25.

Figure 7:
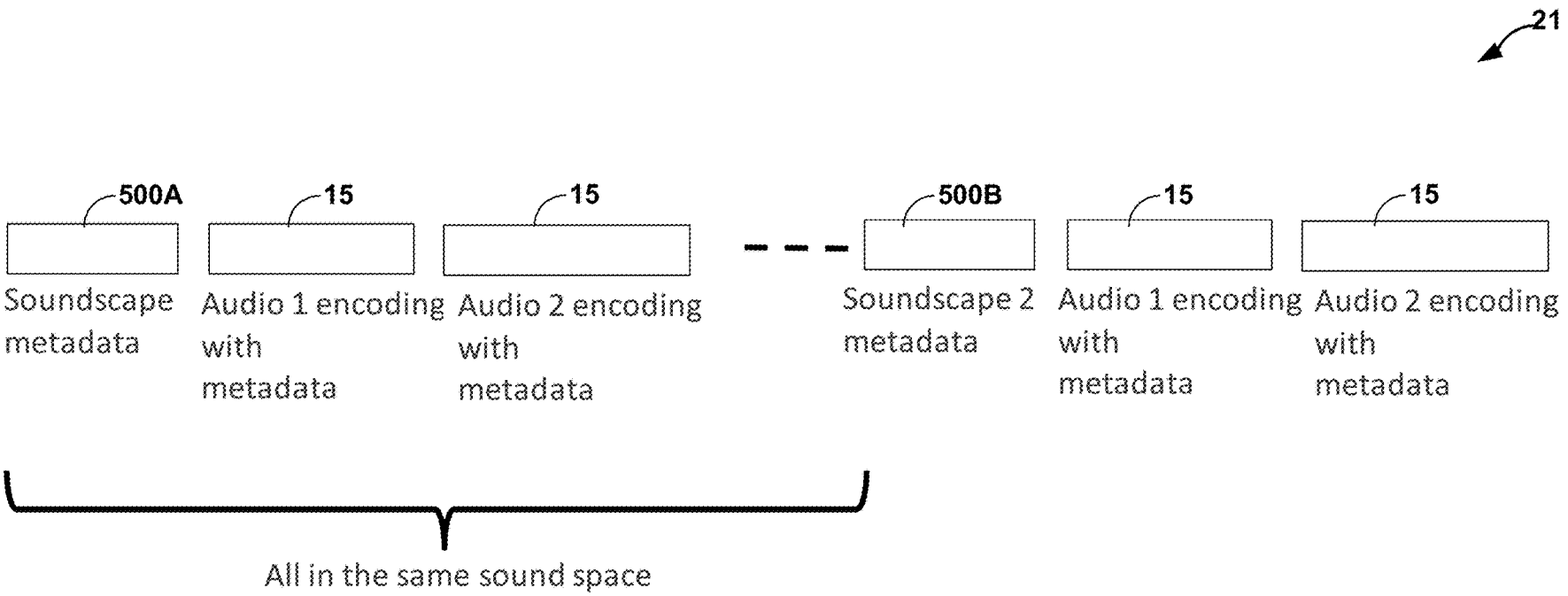
FIG. 7 is a block diagram illustrating an example portion of the audio bitstream of FIG. 1A formed in accordance with various aspects of the techniques described in this disclosure.

FIG. 7 is a block diagram illustrating an example portion of the audio bitstream of FIG. 1A formed in accordance with various aspects of the techniques described in this disclosure. In the example of FIG. 7, the audio bitstream 21 includes soundscape (which is another way to refer to a soundfield) metadata 500A associated with corresponding different sets of the audio data 15 having associated metadata, soundscape metadata 500B associated with corresponding different sets of the audio data 15 having associated metadata, and so on.

Each of the different sets of the audio data 15 associated with the same soundscape metadata 500A or 500B may all reside within the same sound space. Grouping of the different sets of the audio data 15 with a single soundscape metadata 500 may apply, as some examples, to different sets of the audio data 15 representative of crowds of people, groups of cars, or other sounds in close proximity to one another. Associating a single soundscape metadata 500A or 500B with the different sets of the audio data 15 may result in a more efficient bitstream 21 that reduces processing cycles, bandwidth (including bus bandwidth) and memory consumption (compared to having separate soundscape metadata 500 for each of the different sets of the audio data 15).

Figure 8:
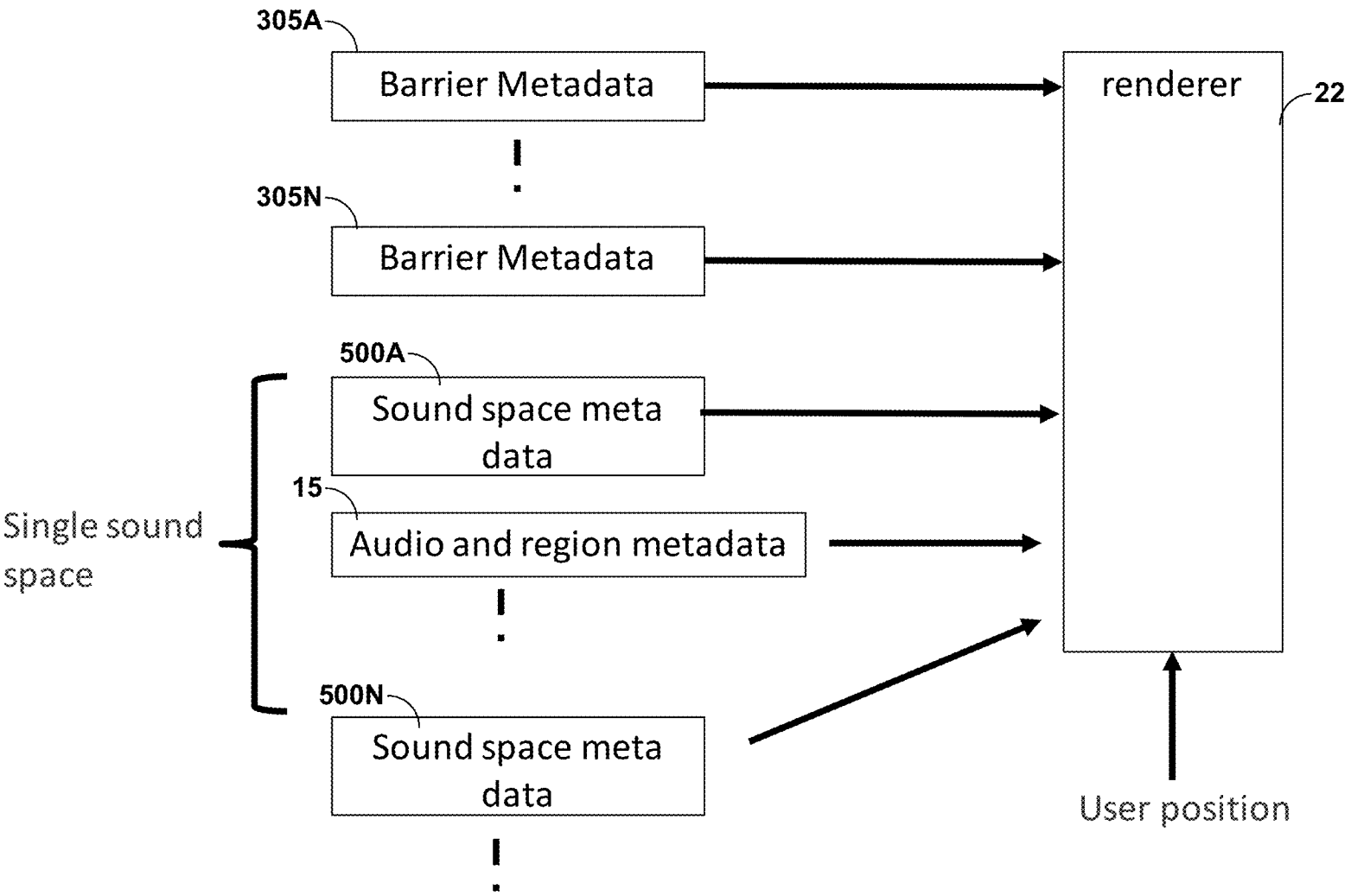
FIG. 8 is a block diagram of the inputs used to configure the occlusion aware renderer of FIG. 1 in accordance with various aspects of the techniques described in this disclosure.

FIG. 8 is a block diagram of the inputs used to configure the occlusion aware renderer of FIG. 1 in accordance with various aspects of the techniques described in this disclosure. As shown in the example of FIG. 8, the audio decoding device 24 may utilize barrier (or, in other words, occlusion) metadata 305A-305N, soundscape metadata 500A-500N (which may be referred to as "sound space metadata 500"), and user position 317 (which is another way of referring to location 317).

The following tables specify an example of what metadata may be specified in support of the various aspects of the occlusion-aware rendering techniques described in this disclosure.

| Metadata | Value Types |
|---|---|
| Environment Mode | Bitmask<br>Enable/disable BRIR.<br>BRIR is disabled in the case of a free field soundscape where only HRTFs should be used.<br>Also overrides reverb, meaning no reverb applied.<br>Room Model<br>Recreate BRIR<br>(HRTF + Room Model Metadata → BRIR)<br>Low/high bandwidth TX<br>Room Model metadata on next slide<br>Single barrier → only scattering<br>Acoustic medium (air, water, . . . etc.)<br>Simple/Complex Occlusion Model<br>Low latency mode. For example social VR, all tools that require extra delay (LN, DRC, limiter) shall be bypassed |
| Audio Environment | See next table |

| Audio Environment | Metadata | Description |
|---|---|---|
| Soundscape | Radius | Meters |
| Barrier | Material Name | For machine learning recommender system or simplified occlusion model filter description |
| | Material Absorption $\alpha$ | 0-1 |
| | Material Leakage x of $\alpha$ | 0-1 |
| | Barrier Constant $K_b$ | [dB] |

-continued

| Audio Environment | Metadata | Description |
|---|---|---|
| Sound Space | Acoustic Boundary | Specified as vertices or co-ordinates joining points Or radius parameter for cylindrical or spherical barriers. |
| Room, Low Bandwidth TX | T60 | ms |
| | Direct to reverberant ratio at specific position Change in direct to reverberant position with distance | |
| | First Reflection Time | ms |
| Room, High Bandwidth TX | HRTF + Low Bandwidth TX Room Metadata | For use with a convolution based renderer |

FIG. 1B is a block diagram illustrating another example system 100 configured to perform various aspects of the techniques described in this disclosure. The system 100 is similar to the system 10 shown in FIG. 1A, except that the audio renderers 22 shown in FIG. 1A are replaced with a binaural renderer 102 capable of performing binaural rendering using one or more HRTFs or the other functions capable of rendering to left and right speaker feeds 103.

The audio playback system 16 may output the left and right speaker feeds 103 to headphones 104, which may represent another example of a wearable device and which may be coupled to additional wearable devices to facilitate reproduction of the soundfield, such as a watch, the VR headset noted above, smart glasses, smart clothing, smart rings, smart bracelets or any other types of smart jewelry (including smart necklaces), and the like. The headphones 104 may couple wirelessly or via wired connection to the additional wearable devices.

Additionally, the headphones 104 may couple to the audio playback system 16 via a wired connection (such as a standard 3.5 mm audio jack, a universal system bus (USB) connection, an optical audio jack, or other forms of wired connection) or wirelessly (such as by way of a Bluetooth™ connection, a wireless network connection, and the like). The headphones 104 may recreate, based on the left and right speaker feeds 103, the soundfield represented by the audio data 11. The headphones 104 may include a left headphone speaker and a right headphone speaker which are powered (or, in other words, driven) by the corresponding left and right speaker feeds 103.

Although described with respect to particular examples of wearable devices, such as the VR device 400 discussed above with respect to the examples of FIG. 2 and other devices set forth in the examples of FIGS. 1A and 1B, a person of ordinary skill in the art would appreciate that descriptions related to FIGS. 1A-2 may apply to other examples of wearable devices. For example, other wearable devices, such as smart glasses, may include sensors by which to obtain translational head movements. As another example, other wearable devices, such as a smart watch, may include sensors by which to obtain translational movements. As such, the techniques described in this disclosure should not be limited to a particular type of wearable device, but any wearable device may be configured to perform the techniques described in this disclosure.

Figure 10A:
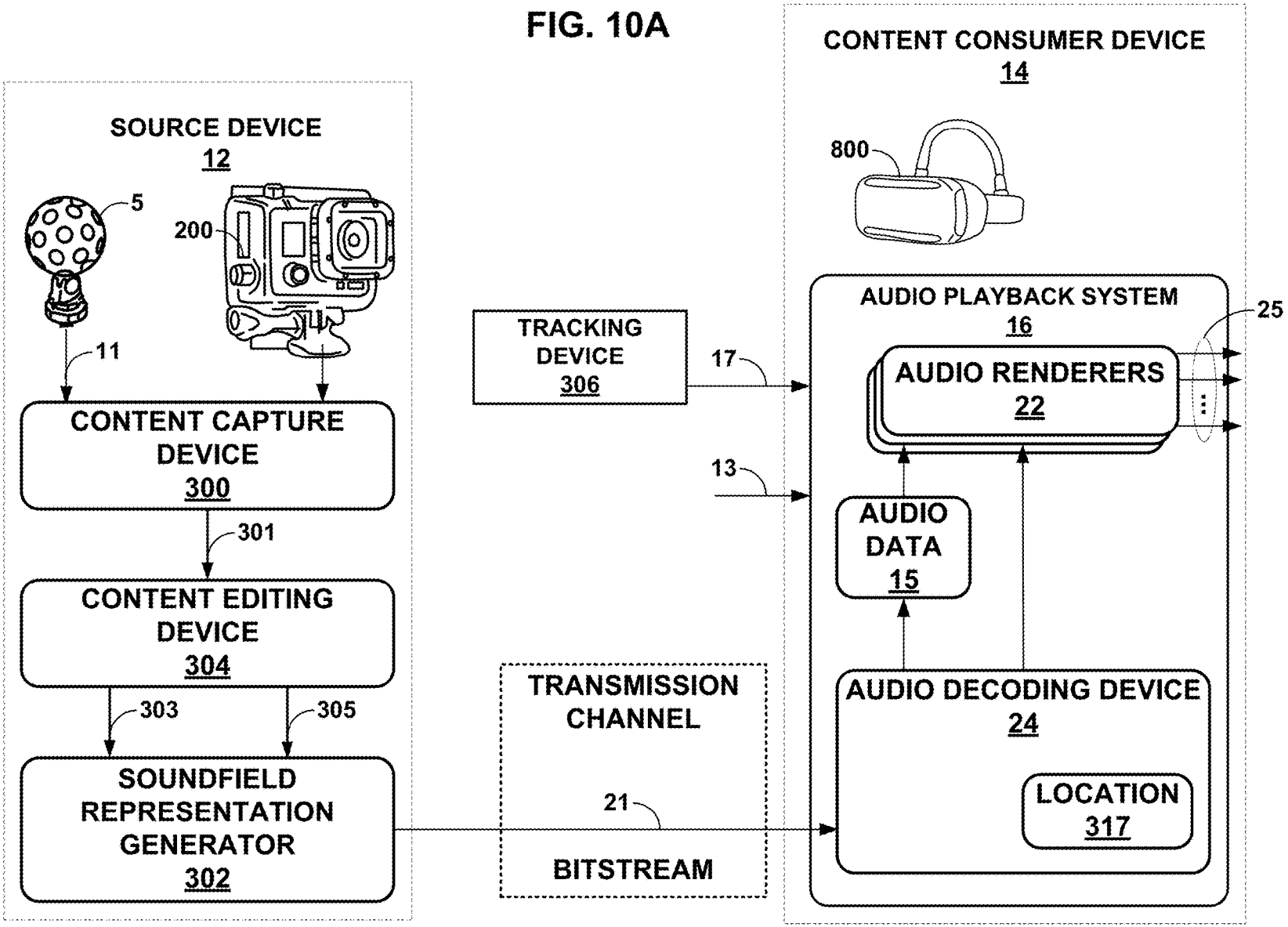
FIGS. 10A and 10B are diagrams illustrating other example systems that may perform various aspects of the techniques described in this disclosure.
Figure 10B:
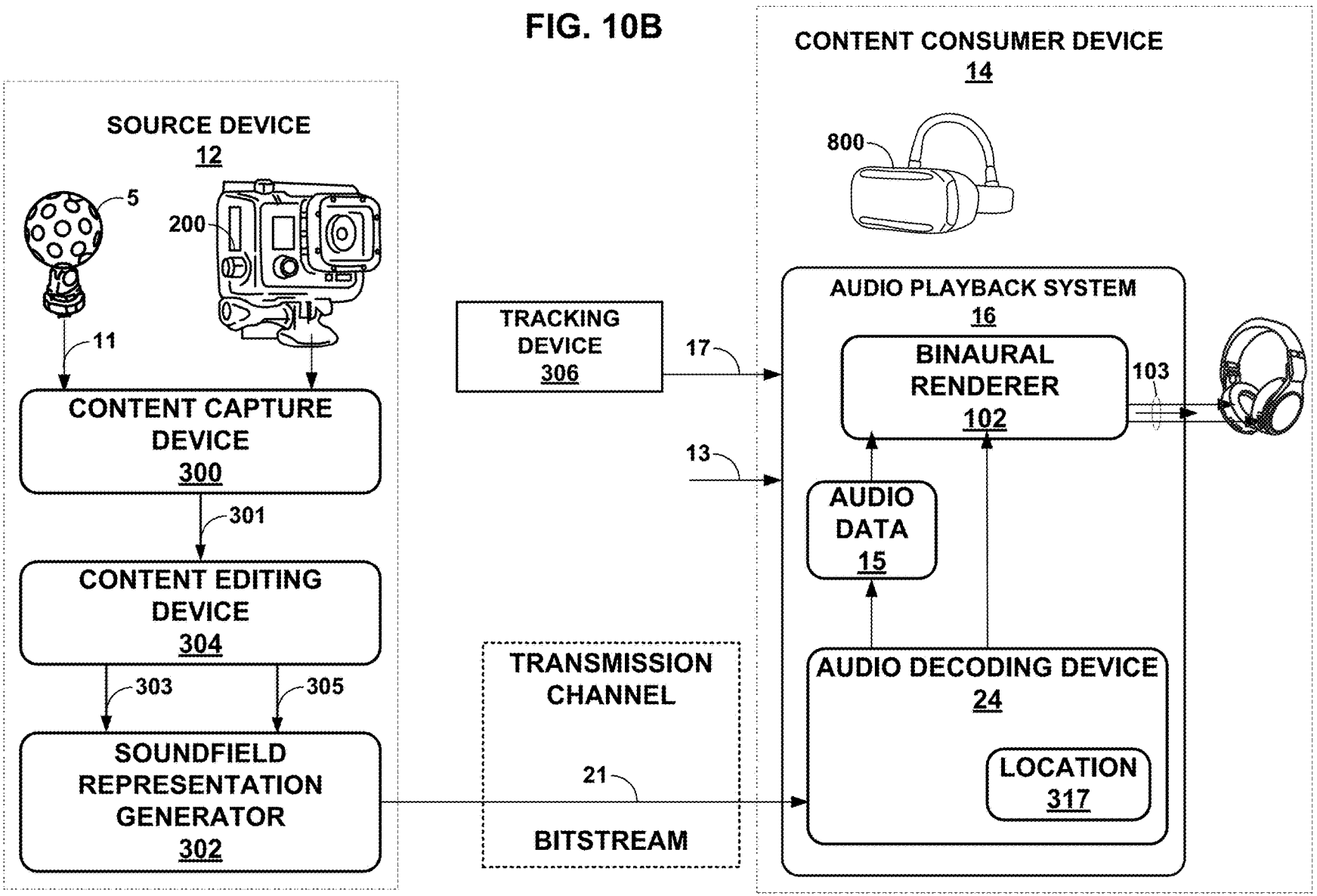

FIGS. 10A and 10B are diagrams illustrating example systems that may perform various aspects of the techniques described in this disclosure. FIG. 10A illustrates an example in which the source device 12 further includes a camera 200. The camera 200 may be configured to capture video data, and provide the captured raw video data to the content capture device 300. The content capture device 300 may provide the video data to another component of the source device 12, for further processing into viewport-divided portions.

In the example of FIG. 10A, the content consumer device 14 also includes the wearable device 800. It will be understood that, in various implementations, the wearable device 800 may be included in, or externally coupled to, the content consumer device 14. As discussed above with respect to FIGS. 10A and 10B, the wearable device 800 includes display hardware and speaker hardware for outputting video data (e.g., as associated with various viewports) and for rendering audio data.

FIG. 10B illustrates an example similar that illustrated by FIG. 10A, except that the audio renderers 22 shown in FIG. 10A are replaced with a binaural renderer 102 capable of performing binaural rendering using one or more HRTFs or the other functions capable of rendering to left and right speaker feeds 103. The audio playback system 16 may output the left and right speaker feeds 103 to headphones 104.

The headphones 104 may couple to the audio playback system 16 via a wired connection (such as a standard 3.5 mm audio jack, a universal system bus (USB) connection, an optical audio jack, or other forms of wired connection) or wirelessly (such as by way of a Bluetooth™ connection, a wireless network connection, and the like). The headphones 104 may recreate, based on the left and right speaker feeds 103, the soundfield represented by the audio data 11. The headphones 104 may include a left headphone speaker and a right headphone speaker which are powered (or, in other words, driven) by the corresponding left and right speaker feeds 103.

Figure 11:
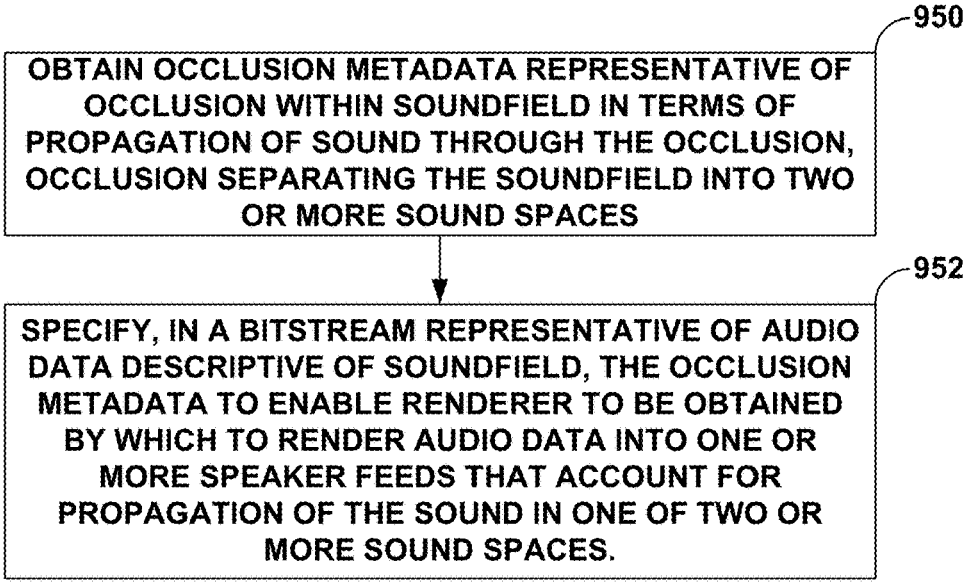
FIG. 11 is a flowchart illustrating example operation of the systems of FIGS. 1A and 1B in performing various aspects of the techniques described in this disclosure.

FIG. 11 is a flowchart illustrating example operation of the source device shown in FIG. 1A in performing various aspects of the techniques described in this disclosure. The source device 12 may obtain occlusion metadata (which may represent a portion of the metadata 305, and as such may be referred to as "occlusion metadata 305") representative of an occlusion within the soundfield (represented by the edited audio data, which may form a portion of edited content 303 and as such may be denoted "edited audio data 305") in terms of propagation of sound through the occlusion, where the occlusion separates the soundfield into two or more sound spaces (950). An audio editor may, when editing audio data 301 and in some examples, specify the occlusion metadata 305.

The soundfield representation generator 302 may specify, in the audio bitstream 21 representative of the edited audio content 303 (which may refer to one of the one or more bitstreams 21), the occlusion metadata 305 to enable a renderer 22 to be obtained (by, e.g., the audio playback system 16) by which to render the edited audio content 303 into one or more speaker feeds 25 to model (or in other words, take into account of) how the sound propagates in one of two or more sound spaces separated by the occlusion (or, in slightly different words, that account for the propagation of sound in one of the two or more sound spaces separated by the occlusion) (952).

Figure 12:
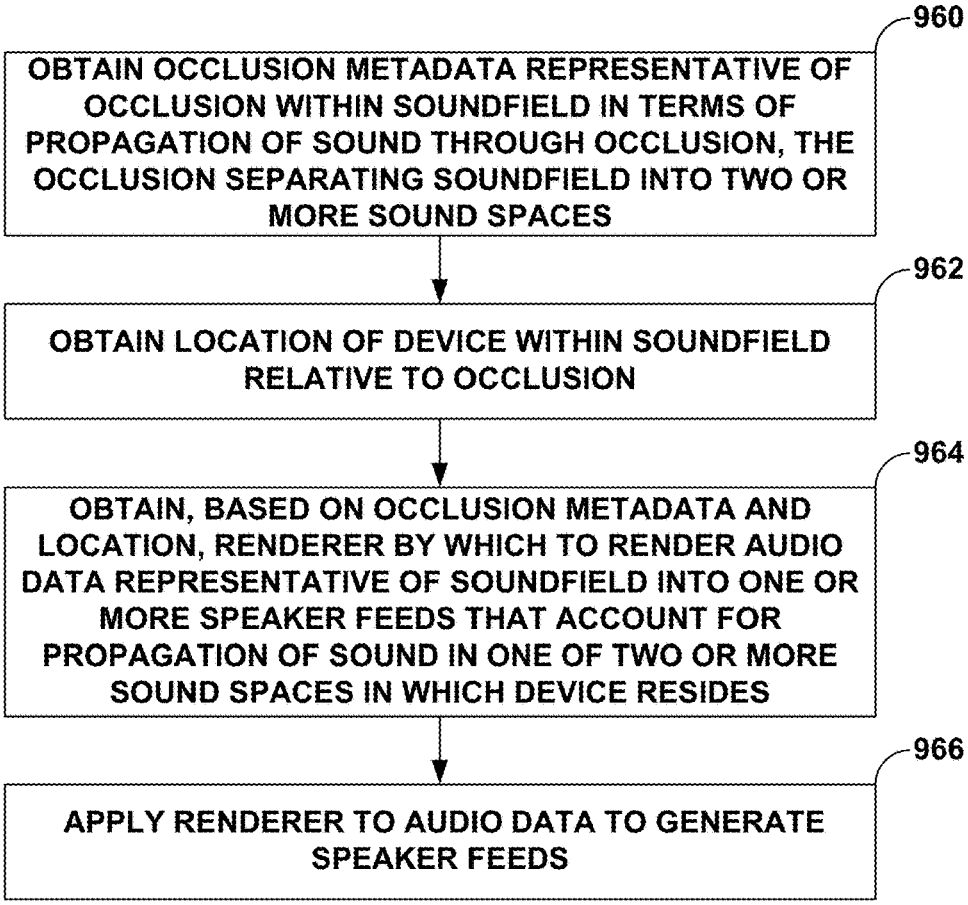
FIG. 12 is a flowchart illustrating example operation of the audio playback system shown in the example of FIG. 1A in performing various aspects of the techniques described in this disclosure.

FIG. 12 is a flowchart illustrating example operation of the audio playback system shown in the example of FIG. 1A in performing various aspects of the techniques described in this disclosure. The audio decoding device 24 (of the audio playback system 16) may obtain, in some examples from the audio bitstream 21, the occlusion metadata 305 representative of the occlusion within the soundfield in terms of propagation of sound through the occlusion, where again the occlusion may separate the soundfield into two or more sound spaces (960). The audio decoding device 24 may also obtain a location 17 of the device (which in this instance may refer to the audio playback system 16 of which one example is the VR device) within the soundfield relative to the occlusion (962).

The audio decoding device 24 may obtain, based on the occlusion metadata 305 and the location 17, an occlusion-aware renderer 22 by which to render audio data 15 representative of the soundfield into one or more speaker feeds 25 that account for propagation of sound in one of the two or more sound spaces in which the audio playback system 16 resides (e.g., virtually) (964). The audio playback system 16 may next apply the occlusion-aware renderer 25 to the audio data 15 to generate the speaker feeds 25 (966).

Figure 13:
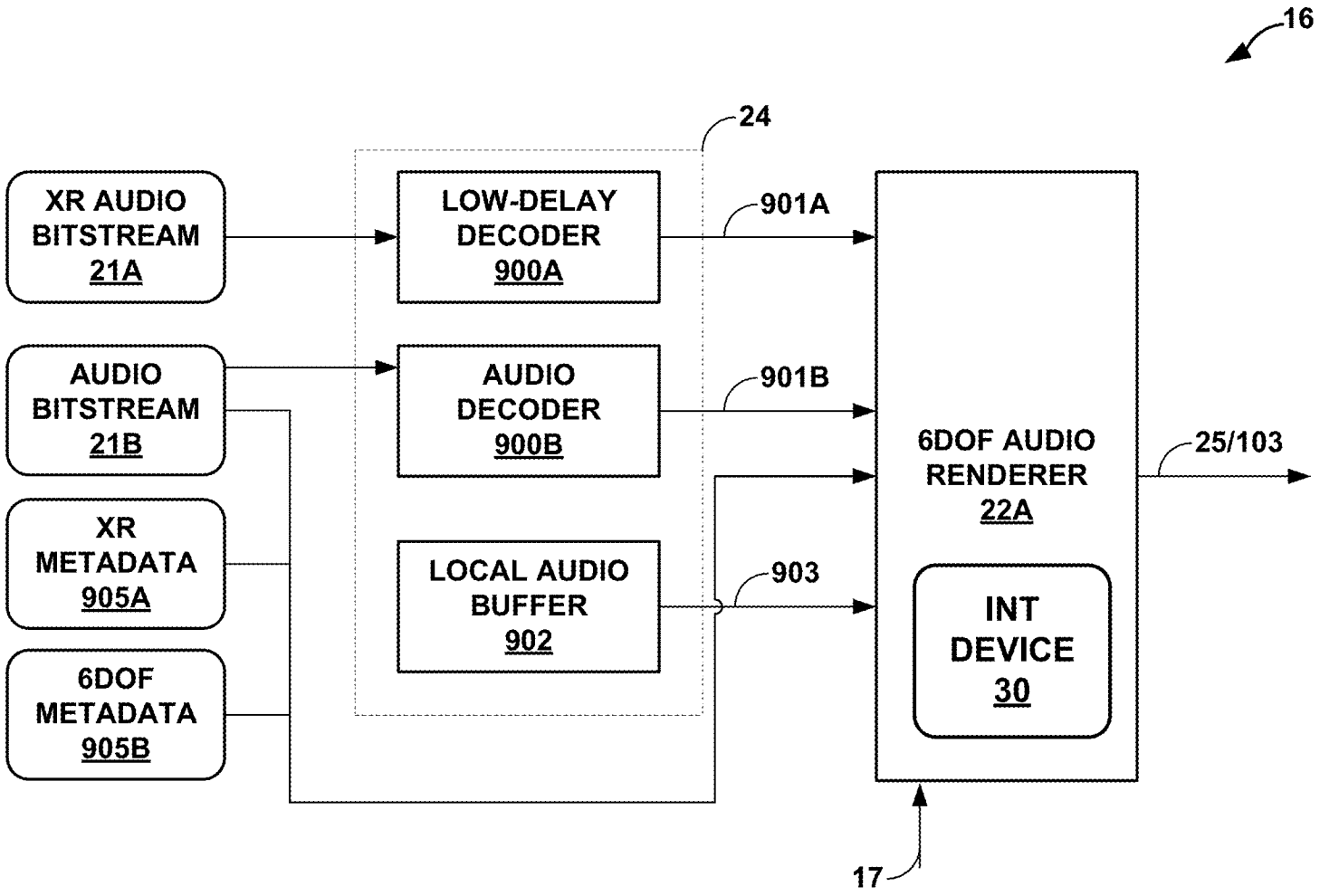
FIG. 13 is a block diagram of the audio playback device shown in the examples of FIGS. 1A and 1B in performing various aspects of the techniques described in this disclosure.

FIG. 13 is a block diagram of the audio playback device shown in the examples of FIGS. 1A and 1B in performing various aspects of the techniques described in this disclosure. The audio playback device 16 may represent an example of the audio playback device 16A and/or the audio playback device 16B. The audio playback system 16 may include the audio decoding device 24 in combination with a 6DOF audio renderer 22A, which may represent one example of the audio renderers 22 shown in the example of FIG. 1A.

The audio decoding device 24 may include a low delay decoder 900A, an audio decoder 900B, and a local audio buffer 902. The low delay decoder 900A may process XR audio bitstream 21A to obtain audio stream 901A, where the low delay decoder 900A may perform relatively low complexity decoding (compared to the audio decoder 900B) to facilitate low delay reconstruction of the audio stream 901A. The audio decoder 900B may perform relatively higher complexity decoding (compared to the audio decoder 900A) with respect to the audio bitstream 21B to obtain audio stream 901B. The audio decoder 900B may perform audio decoding that conforms to the MPEG-H 3D Audio coding standard. The local audio buffer 902 may represent a unit configured to buffer local audio content, which the local audio buffer 902 may output as audio stream 903.

The bitstream 21 (comprised of one or more of the XR audio bitstream 21A and/or the audio bitstream 21B) may also include XR metadata 905A (which may include the microphone location information noted above) and 6DOF metadata 905B (which may specify various parameters related to 6DOF audio rendering). The 6DOF audio renderer 22A may obtain the audio streams 901A, 901B, and/or 903 along with the XR metadata 905A and the 6DOF metadata 905B and render the speaker feeds 25 and/or 103 based on the listener positions and the microphone positions. In the example of FIG. 13, the 6DOF audio renderer 22A includes the interpolation device 30, which may perform various aspects of the audio stream selection and/or interpolation techniques described in more detail above to facilitate 6DOF audio rendering.

Figure 14:
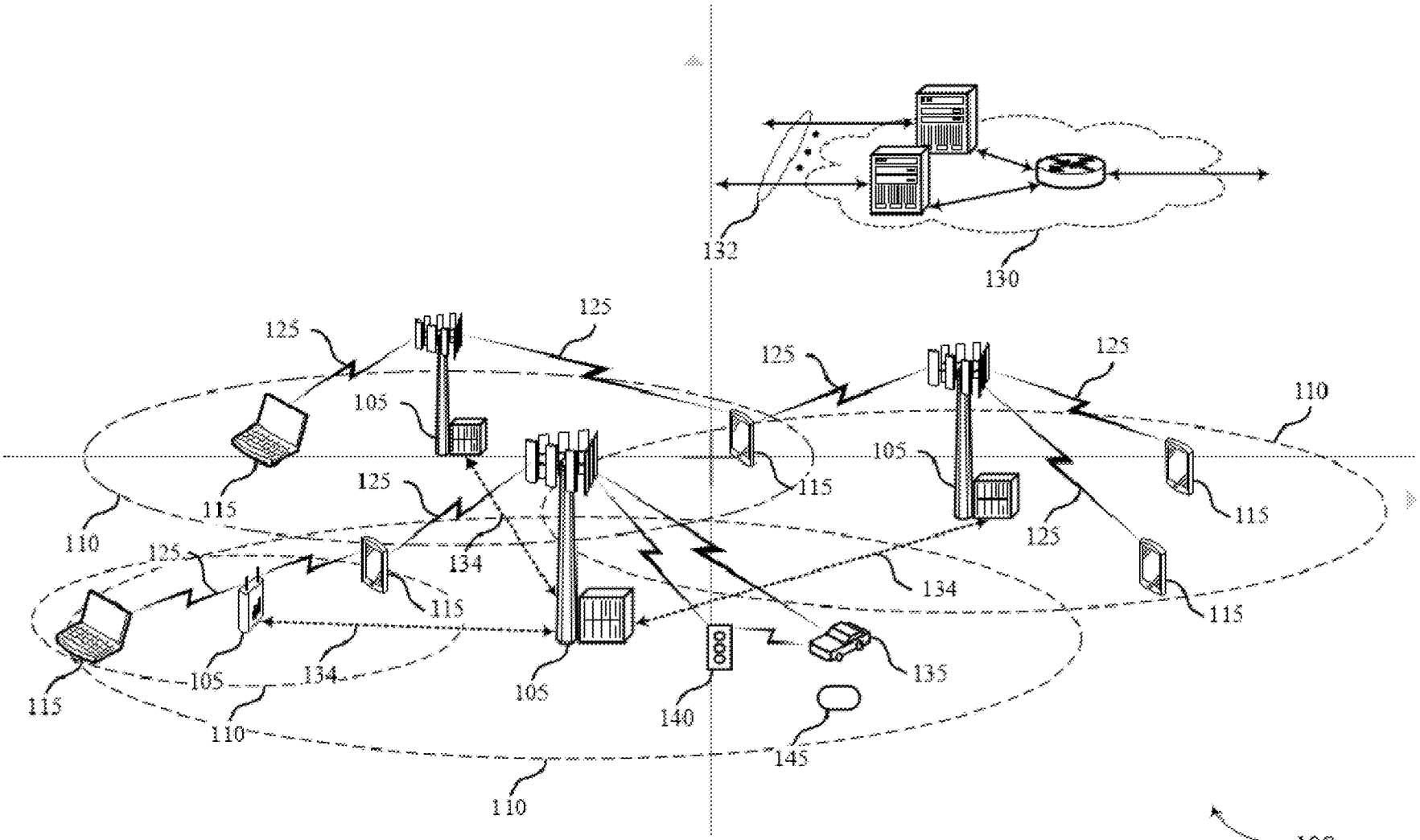
FIG. 14 illustrates an example of a wireless communications system that supports audio streaming in accordance with aspects of the present disclosure.

FIG. 14 illustrates an example of a wireless communications system 100 that supports audio streaming in accordance with aspects of the present disclosure. The wireless communications system 100 includes base stations 105, UEs 115, and a core network 130. In some examples, the wireless communications system 100 may be a Long Term Evolution (LTE) network, an LTE-Advanced (LTE-A) network, an LTE-A Pro network, or a New Radio (NR) network. In some cases, wireless communications system 100 may support enhanced broadband communications, ultra-reliable (e.g., mission critical) communications, low latency communications, or communications with low-cost and low-complexity devices.

Base stations 105 may wirelessly communicate with UEs 115 via one or more base station antennas. Base stations 105 described herein may include or may be referred to by those skilled in the art as a base transceiver station, a radio base station, an access point, a radio transceiver, a NodeB, an eNodeB (eNB), a next-generation NodeB or giga-NodeB (either of which may be referred to as a gNB), a Home NodeB, a Home eNodeB, or some other suitable terminology. Wireless communications system 100 may include base stations 105 of different types (e.g., macro or small cell base stations). The UEs 115 described herein may be able to communicate with various types of base stations 105 and network equipment including macro eNBs, small cell eNBs, gNBs, relay base stations, and the like.

Each base station 105 may be associated with a particular geographic coverage area 110 in which communications with various UEs 115 is supported. Each base station 105 may provide communication coverage for a respective geographic coverage area 110 via communication links 125, and communication links 125 between a base station 105 and a UE 115 may utilize one or more carriers. Communication links 125 shown in wireless communications system 100 may include uplink transmissions from a UE 115 to a base station 105, or downlink transmissions from a base station 105 to a UE 115. Downlink transmissions may also be called forward link transmissions while uplink transmissions may also be called reverse link transmissions.

The geographic coverage area 110 for a base station 105 may be divided into sectors making up a portion of the geographic coverage area 110, and each sector may be associated with a cell. For example, each base station 105 may provide communication coverage for a macro cell, a small cell, a hot spot, or other types of cells, or various combinations thereof. In some examples, a base station 105 may be movable and therefore provide communication coverage for a moving geographic coverage area 110. In some examples, different geographic coverage areas 110 associated with different technologies may overlap, and overlapping geographic coverage areas 110 associated with different technologies may be supported by the same base station 105 or by different base stations 105. The wireless communications system 100 may include, for example, a heterogeneous LTE/LTE-A/LTE-A Pro or NR network in which different types of base stations 105 provide coverage for various geographic coverage areas 110.

UEs 115 may be dispersed throughout the wireless communications system 100, and each UE 115 may be stationary or mobile. A UE 115 may also be referred to as a mobile device, a wireless device, a remote device, a handheld device, or a subscriber device, or some other suitable terminology, where the "device" may also be referred to as a unit, a station, a terminal, or a client. A UE 115 may also be a personal electronic device such as a cellular phone, a personal digital assistant (PDA), a tablet computer, a laptop computer, or a personal computer. In examples of this disclosure, a UE 115 may be any of the audio sources described in this disclosure, including a VR headset, an XR headset, an AR headset, a vehicle, a smartphone, a microphone, an array of microphones, or any other device including a microphone or is able to transmit a captured and/or synthesized audio stream. In some examples, an synthesized audio stream may be an audio stream that that was stored in memory or was previously created or synthesized. In some examples, a UE 115 may also refer to a wireless local loop (WLL) station, an Internet of Things (IoT) device, an Internet of Everything (IoE) device, or an MTC device, or the like, which may be implemented in various articles such as appliances, vehicles, meters, or the like.

Some UEs 115, such as MTC or IoT devices, may be low cost or low complexity devices, and may provide for automated communication between machines (e.g., via Machine-to-Machine (M2M) communication). M2M communication or MTC may refer to data communication technologies that allow devices to communicate with one another or a base station 105 without human intervention. In some examples, M2M communication or MTC may include communications from devices that exchange and/or use audio metadata indicating privacy restrictions and/or password-based privacy data to toggle, mask, and/or null various audio streams and/or audio sources as will be described in more detail below.

In some cases, a UE 115 may also be able to communicate directly with other UEs 115 (e.g., using a peer-to-peer (P2P) or device-to-device (D2D) protocol). One or more of a group of UEs 115 utilizing D2D communications may be within the geographic coverage area 110 of a base station 105. Other UEs 115 in such a group may be outside the geographic coverage area 110 of a base station 105, or be otherwise unable to receive transmissions from a base station 105. In some cases, groups of UEs 115 communicating via D2D communications may utilize a one-to-many (1:M) system in which each UE 115 transmits to every other UE 115 in the group. In some cases, a base station 105 facilitates the scheduling of resources for D2D communications. In other cases, D2D communications are carried out between UEs 115 without the involvement of a base station 105.

Base stations 105 may communicate with the core network 130 and with one another. For example, base stations 105 may interface with the core network 130 through backhaul links 132 (e.g., via an S1, N2, N3, or other interface). Base stations 105 may communicate with one another over backhaul links 134 (e.g., via an X2, Xn, or other interface) either directly (e.g., directly between base stations 105) or indirectly (e.g., via core network 130).

In some cases, wireless communications system 100 may utilize both licensed and unlicensed radio frequency spectrum bands. For example, wireless communications system 100 may employ License Assisted Access (LAA), LTE-Unlicensed (LTE-U) radio access technology, or NR technology in an unlicensed band such as the 5 GHz ISM band. When operating in unlicensed radio frequency spectrum bands, wireless devices such as base stations 105 and UEs 115 may employ listen-before-talk (LBT) procedures to ensure a frequency channel is clear before transmitting data. In some cases, operations in unlicensed bands may be based on a carrier aggregation configuration in conjunction with component carriers operating in a licensed band (e.g., LAA). Operations in unlicensed spectrum may include downlink transmissions, uplink transmissions, peer-to-peer transmissions, or a combination of these. Duplexing in unlicensed spectrum may be based on frequency division duplexing (FDD), time division duplexing (TDD), or a combination of both.

In this respect, various aspects of the techniques are described that enable one or more of the examples set forth in the following clauses:

Clause 1A. A device comprising: a memory configured to store audio data representative of a soundfield; and one or more processors coupled to the memory, and configured to: obtain occlusion metadata representative of an occlusion within the soundfield in terms of propagation of sound through the occlusion, the occlusion separating the soundfield into two or more sound spaces; obtain a location of the device within the soundfield relative to the occlusion; obtain, based on the occlusion metadata and the location, a renderer by which to render the audio data into one or more speaker feeds that account for propagation of the sound in one of the two or more sound spaces in which the device resides; and apply the renderer to the audio data to generate the speaker feeds.

Clause 2A. The device of clause 1A, wherein the one or more processors are further configured to obtain environment metadata describing a virtual environment in which the device resides, and wherein the one or more processors are configured to obtain, based on the occlusion metadata, the location, and the environment metadata, the renderer.

Clause 3A. The device of clause 2A, wherein the environment metadata describes a virtual indoor environment, and wherein the one or more processors are configured to obtain, when the environment metadata describes the virtual indoor environment, and based on the occlusion metadata and the location, a binaural room impulse response renderer.

Clause 4A. The device of clause 2A, wherein the environment metadata describes a virtual outdoor environment, and wherein the one or more processors are configured to obtain, when the environment metadata describes the virtual outdoor environment, and based on the occlusion metadata and the location, a head related transfer function renderer.

Clause 5A. The device of any combination of clauses 1A-4A, wherein the occlusion metadata includes a volume attenuation factor representative of an amount a volume associated with the audio data is reduced while passing through the occlusion.

Clause 6A. The device of any combination of clauses 1A-5A, wherein the occlusion metadata includes a direct path only indication representative of whether a direct path exists for the audio data or reverberation processing is to be applied to the audio data.

Clause 7A. The device of any combination of clauses 1A-6A, wherein the occlusion metadata includes a low pass filter description representative of coefficients to describe low pass filter or a parametric description of the low pass filter.

Clause 8A. The device of any combination of clauses 1A-7A, wherein the occlusion metadata includes an indication of a location of the occlusion.

Clause 9A. The device of any combination of clauses 1A-8A, wherein the occlusion metadata includes first occlusion metadata for a first sound space of the two or more sound spaces and second occlusion metadata for a second sound space of the two or more sound spaces, and wherein the one or more processors are configured to: obtain a first renderer by which to render at least a first portion of the audio data into one or more first speaker feeds to model how the sound propagates in the first sound space; obtain a second renderer by which to render at least a second portion of the audio data into one or more second speaker feeds to model how the sound propagates in the second sound space; apply the first renderer to the first portion of the audio data to generate the first speaker feeds; and apply the second renderer to the second portion of the audio data to generate the second speaker feeds, and wherein the processor is further configured to obtain, based on the first speaker feeds and the second speaker feeds, the speaker feeds.

Clause 10A. The device of any combination of clauses 1A-9A, wherein the audio data comprises scene-based audio data.

Clause 11A. The device of any combination of clauses 1A-9A, wherein the audio data comprises object-based audio data.

Clause 12A. The device of any combination of clauses 1A-9A, wherein the audio data comprises channel-based audio data.

Clause 13A. The device of any combination of clauses 1A-9A, wherein the audio data comprises a first group of audio objects included in a first sound space of the two or more sound spaces, wherein the one or more processors are configured to: obtain, based on the occlusion metadata and the location, a first renderer for the first group of audio objects, and wherein the one or more processors are configured to apply the first renderer to the first group of audio objects to obtain first speaker feeds.

Clause 14A. The device of clause 13A, wherein the audio data comprises a second group of objects included in a second sound space of the two or more sound spaces, wherein the one or more processors are further configured to obtain, based on the occlusion metadata and the location, a second renderer for the second group of objects, and wherein the one or more processors are configured to: apply the second renderer to the second group of objects to obtain the second speaker feeds, and obtain, based on the first speaker feeds and the second speaker feeds, the speaker feeds.

Clause 15A. The device of any combination of clauses 1A-14A, wherein the device includes a virtual reality headset coupled to one or more speakers configured to reproduce, based on the speaker feeds, the soundfield.

Clause 16A. The device of any combination of clauses 1A-14A, wherein the device includes an augmented reality headset coupled to one or more speakers configured to reproduce, based on the speaker feeds, the soundfield.

Clause 17A. The device of any combination of clauses 1A-14A, wherein the device includes one or more speakers configured to reproduce, based on the speaker feeds, the soundfield.

Clause 18A. A method comprising: obtaining, by a device, occlusion metadata representative of an occlusion within a soundfield in terms of propagation of sound through the occlusion, the occlusion separating the soundfield into two or more sound spaces; obtaining, by the device, a location of the device within the soundfield relative to the occlusion; obtaining, by the device, based on the occlusion metadata and the location, a renderer by which to render audio data representative of the soundfield into one or more speaker feeds that account for propagation of the sound in one of the two or more sound spaces in which the device resides; and applying, by the device, the renderer to the audio data to generate the speaker feeds.

Clause 19A. The method of clause 18A, further comprising obtaining environment metadata describing a virtual environment in which the device resides, wherein obtaining the renderer comprises obtaining, based on the occlusion metadata, the location, and the environment metadata, the renderer.

Clause 20A. The method of clause 19A, wherein the environment metadata describes a virtual indoor environment, and wherein obtaining the renderer comprises obtaining, when the environment metadata describes the virtual indoor environment, and based on the occlusion metadata and the location, a binaural room impulse response renderer.

Clause 21A. The method of clause 19A, wherein the environment metadata describes a virtual outdoor environment, and wherein obtaining the renderer comprises obtaining, when the environment metadata describes the virtual outdoor environment, and based on the occlusion metadata and the location, a head related transfer function renderer.

Clause 22A. The method of any combination of clauses 18A-21A, wherein the occlusion metadata includes a volume attenuation factor representative of an amount a volume associated with the audio data is reduced while passing through the occlusion.

Clause 23A. The method of any combination of clauses 18A-22A, wherein the occlusion metadata includes a direct path only indication representative of whether a direct path exists for the audio data or reverberation processing is to be applied to the audio data.

Clause 24A. The method of any combination of clauses 18A-23A, wherein the occlusion metadata includes a low pass filter description representative of coefficients to describe low pass filter or a parametric description of the low pass filter.

Clause 25A. The method of any combination of clauses 18A-24A, wherein the occlusion metadata includes an indication of a location of the occlusion.

Clause 26A. The method of any combination of clauses 18A-25A, wherein the occlusion metadata includes first occlusion metadata for a first sound space of the two or more sound spaces and second occlusion metadata for a second sound space of the two or more sound spaces, and wherein obtaining the renderer comprises: obtaining a first renderer by which to render at least a first portion of the audio data into one or more first speaker feeds to model how the sound propagates in the first sound space; and obtaining a second renderer by which to render at least a second portion of the audio data into one or more second speaker feeds to model how the sound propagates in the second sound space; wherein applying the renderer comprises: applying the first renderer to the first portion of the audio data to generate the first speaker feeds; applying the second renderer to the second portion of the audio data to generate the second speaker feeds, and wherein the method further comprises obtaining, based on the first speaker feeds and the second speaker feeds, the speaker feeds.

Clause 27A. The method of any combination of clauses 18A-26A, wherein the audio data comprises scene-based audio data.

Clause 28A. The method of any combination of clauses 18A-26A, wherein the audio data comprises object-based audio data.

Clause 29A. The method of any combination of clauses 18A-26A, wherein the audio data comprises channel-based audio data.

Clause 30A. The method of any combination of clauses 18A-26A, wherein the audio data comprises a first group of audio objects included in a first sound space of the two or more sound spaces, wherein obtaining the renderer comprises obtaining, based on the occlusion metadata and the location, a first renderer for the first group of audio objects, and wherein applying the renderer comprises applying the first renderer to the first group of audio objects to obtain first speaker feeds.

Clause 31A. The method of clause 30A, wherein the audio data comprises a second group of objects included in a second sound space of the two or more sound spaces, and wherein the method further comprises: obtaining, based on the occlusion metadata and the location, a second renderer for the second group of objects, applying the second renderer to the second group of objects to obtain the second speaker feeds, and obtaining, based on the first speaker feeds and the second speaker feeds, the speaker feeds.

Clause 32A. The method of any combination of clauses 18A-31A, wherein the device includes a virtual reality headset coupled to one or more speakers configured to reproduce, based on the speaker feeds, the soundfield.

Clause 33A. The method of any combination of clauses 18A-31A, wherein the device includes an augmented reality headset coupled to one or more speakers configured to reproduce, based on the speaker feeds, the soundfield.

Clause 34A. The method of any combination of clauses 18A-31A, wherein the device includes one or more speakers configured to reproduce, based on the speaker feeds, the soundfield.

Clause 35A. A device comprising: means for obtaining occlusion metadata representative of an occlusion within a soundfield in terms of propagation of sound through the occlusion, the occlusion separating the soundfield into two or more sound spaces; means for obtaining a location of the device within the soundfield relative to the occlusion; means for obtaining, based on the occlusion metadata and the location, a renderer by which to render audio data representative of the soundfield into one or more speaker feeds that account for propagation of the sound in one of the two or more sound spaces in which the device resides; and means for applying the renderer to the audio data to generate the speaker feeds.

Clause 36A. The device of clause 35A, further comprising means for obtaining environment metadata describing a virtual environment in which the device resides, wherein the means for obtaining the renderer comprises means for obtaining, based on the occlusion metadata, the location, and the environment metadata, the renderer.

Clause 37A. The device of clause 36A, wherein the environment metadata describes a virtual indoor environment, and wherein the means for obtaining the renderer comprises means for obtaining, when the environment metadata describes the virtual indoor environment, and based on the occlusion metadata and the location, a binaural room impulse response renderer.

Clause 38A. The device of clause 36A, wherein the environment metadata describes a virtual outdoor environment, and wherein the means for obtaining the renderer comprises means for obtaining, when the environment metadata describes the virtual outdoor environment, and based on the occlusion metadata and the location, a head related transfer function renderer.

Clause 39A. The device of any combination of clauses 35A-38A, wherein the occlusion metadata includes a volume attenuation factor representative of an amount a volume associated with the audio data is reduced while passing through the occlusion.

Clause 40A. The device of any combination of clauses 35A-39A, wherein the occlusion metadata includes a direct path only indication representative of whether a direct path exists for the audio data or reverberation processing is to be applied to the audio data.

Clause 41A. The device of any combination of clauses 35A-40A, wherein the occlusion metadata includes a low pass filter description representative of coefficients to describe low pass filter or a parametric description of the low pass filter.

Clause 42A. The device of any combination of clauses 35A-41A, wherein the occlusion metadata includes an indication of a location of the occlusion.

Clause 43A. The device of any combination of clauses 35A-42A, wherein the occlusion metadata includes first occlusion metadata for a first sound space of the two or more sound spaces and second occlusion metadata for a second sound space of the two or more sound spaces, and wherein the means for obtaining the renderer comprises: means for obtaining a first renderer by which to render at least a first portion of the audio data into one or more first speaker feeds to model how the sound propagates in the first sound space; and means for obtaining a second renderer by which to render at least a second portion of the audio data into one or more second speaker feeds to model how the sound propagates in the second sound space; wherein the means for applying the renderer comprises: means for applying the first renderer to the first portion of the audio data to generate the first speaker feeds; and means for applying the second renderer to the second portion of the audio data to generate the second speaker feeds, wherein the device further comprises means for obtaining, based on the first speaker feeds and the second speaker feeds, the speaker feeds.

Clause 44A. The device of any combination of clauses 35A-43A, wherein the audio data comprises scene-based audio data.

Clause 45A. The device of any combination of clauses 35A-43A, wherein the audio data comprises object-based audio data.

Clause 46A. The device of any combination of clauses 35A-43A, wherein the audio data comprises channel-based audio data.

Clause 47A. The device of any combination of clauses 35A-43A, wherein the audio data comprises a first group of audio objects included in a first sound space of the two or more sound spaces, wherein the means for obtaining the renderer comprises means for obtaining, based on the occlusion metadata and the location, a first renderer for the first group of audio objects, and wherein the means for applying the renderer comprises means for applying the first renderer to the first group of audio objects to obtain first speaker feeds.

Clause 48A. The device of clause 47A, wherein the audio data comprises a second group of objects included in a second sound space of the two or more sound spaces, wherein the device further comprises means for obtaining, based on the occlusion metadata and the location, a second renderer for the second group of objects, wherein the means for applying the renderer comprises: means for applying the second renderer to the second group of objects to obtain the second speaker feeds, and means for obtaining, based on the first speaker feeds and the second speaker feeds, the speaker feeds.

Clause 49A. The device of any combination of clauses 35A-48A, wherein the device includes a virtual reality headset coupled to one or more speakers configured to reproduce, based on the speaker feeds, the soundfield.

Clause 50A. The device of any combination of clauses 35A-48A, wherein the device includes a augmented reality headset coupled to one or more speakers configured to reproduce, based on the speaker feeds, the soundfield.

Clause 51A. The device of any combination of clauses 35A-48A, wherein the device includes one or more speakers configured to reproduce, based on the speaker feeds, the soundfield.

Clause 52A. A non-transitory computer-readable storage medium having stored thereon instructions that, when executed, cause one or more processors of a device to: obtain, occlusion metadata representative of an occlusion within a soundfield in terms of propagation of sound through the occlusion, the occlusion separating the soundfield into two or more sound spaces; obtain a location of the device within the soundfield relative to the occlusion; obtain, based on the occlusion metadata and the location, a renderer by which to render audio data representative of the soundfield into one or more speaker feeds that account for propagation of the sound in one of the two or more sound spaces in which the device resides; and apply the renderer to the audio data to generate the speaker feeds.

Clause 1B. A device comprising: a memory configured to store audio data representative of a soundfield; and one or more processors coupled to the memory, and configured to: obtain occlusion metadata representative of an occlusion within the soundfield in terms of propagation of sound through the occlusion, the occlusion separating the soundfield into two or more sound spaces; and specify, in a bitstream representative of the audio data, the occlusion metadata to enable a renderer to be obtained by which to render the audio data into one or more speaker feeds that account for propagation of the sound in one of the two or more sound spaces.

Clause 2B. The device of clause 1B, wherein the one or more processors are further configured to obtain environment metadata describing a virtual environment in which the device resides, wherein the one or more processors are configured to specify, in the bitstream, the environment metadata.

Clause 3B. The device of clause 2B, wherein the environment metadata describes a virtual indoor environment.

Clause 4B. The device of clause 2B, wherein the environment metadata describes a virtual outdoor environment.

Clause 5B. The device of any combination of clauses 1B-4B, wherein the occlusion metadata includes a volume attenuation factor representative of an amount a volume associated with the audio data is reduced while passing through the occlusion.

Clause 6B. The device of any combination of clauses 1B-5B, wherein the occlusion metadata includes a direct path only indication representative of whether a direct path exists for the audio data or reverberation processing is to be applied to the audio data.

Clause 7B. The device of any combination of clauses 1B-6B, wherein the occlusion metadata includes a low pass filter description representative of coefficients to describe low pass filter or a parametric description of the low pass filter.

Clause 8B. The device of any combination of clauses 1B-7B, wherein the occlusion metadata includes an indication of a location of the occlusion.

Clause 9B. The device of any combination of clauses 1B-8B, wherein the occlusion metadata includes first occlusion metadata for a first sound space of the two or more sound spaces and second occlusion metadata for a second sound space of the two or more sound spaces.

Clause 10B. The device of any combination of clauses 1B-9B, wherein the audio data comprises scene-based audio data.

Clause 11B. The device of any combination of clauses 1B-9B, wherein the audio data comprises object-based audio data.

Clause 12B. The device of any combination of clauses 1B-9B, wherein the audio data comprises channel-based audio data.

Clause 13B. A method comprising: obtaining, by a device, occlusion metadata representative of an occlusion within a soundfield in terms of propagation of sound through the occlusion, the occlusion separating the soundfield into two or more sound spaces; and specifying, by the device, in a bitstream representative of audio data descriptive of the soundfield, the occlusion metadata to enable a renderer to be obtained by which to render the audio data into one or more speaker feeds that account for propagation of the sound in one of the two or more sound spaces.

Clause 14B. The method of clause 13B, further comprising: obtaining environment metadata describing a virtual environment in which the device resides; and specifying, in the bitstream, the environment metadata.

Clause 15B. The method of clause 14B, wherein the environment metadata describes a virtual indoor environment.

Clause 16B. The method of clause 14B, wherein the environment metadata describes a virtual outdoor environment.

Clause 17B. The method of any combination of clauses 13B-16B, wherein the occlusion metadata includes a volume attenuation factor representative of an amount a volume associated with the audio data is reduced while passing through the occlusion.

Clause 18B. The method of any combination of clauses 13B-17B, wherein the occlusion metadata includes a direct path only indication representative of whether a direct path exists for the audio data or reverberation processing is to be applied to the audio data.

Clause 19B. The method of any combination of clauses 13B-18B, wherein the occlusion metadata includes a low pass filter description representative of coefficients to describe low pass filter or a parametric description of the low pass filter.

Clause 20B. The method of any combination of clauses 13B-19B, wherein the occlusion metadata includes an indication of a location of the occlusion.

Clause 21B. The method of any combination of clauses 13B-20B, wherein the occlusion metadata includes first occlusion metadata for a first sound space of the two or more sound spaces and second occlusion metadata for a second sound space of the two or more sound spaces.

Clause 22B. The method of any combination of clauses 13B-21B, wherein the audio data comprises scene-based audio data.

Clause 23B. The method of any combination of clauses 13B-21B, wherein the audio data comprises object-based audio data.

Clause 24B. The method of any combination of clauses 13B-21B, wherein the audio data comprises channel-based audio data.

Clause 25B. A device comprising: means for obtaining occlusion metadata representative of an occlusion within a soundfield in terms of propagation of sound through the occlusion, the occlusion separating the soundfield into two or more sound spaces; and means for specifying, in a bitstream representative of audio data descriptive of the soundfield, the occlusion metadata to enable a renderer to be obtained by which to render the audio data into one or more speaker feeds that account for propagation of the sound in one of the two or more sound spaces.

Clause 26B. The device of clause 25B, further comprising: means for obtaining environment metadata describing a virtual environment in which the device resides, means for specifying, in the bitstream, the environment metadata.

Clause 27B. The device of clause 26B, wherein the environment metadata describes a virtual indoor environment.

Clause 28B. The device of clause 26B, wherein the environment metadata describes a virtual outdoor environment.

Clause 29B. The device of any combination of clauses 25B-28B, wherein the occlusion metadata includes a volume attenuation factor representative of an amount a volume associated with the audio data is reduced while passing through the occlusion.

Clause 30B. The device of any combination of clauses 25B-29B, wherein the occlusion metadata includes a direct path only indication representative of whether a direct path exists for the audio data or reverberation processing is to be applied to the audio data.

Clause 31B. The device of any combination of clauses 25B-30B, wherein the occlusion metadata includes a low pass filter description representative of coefficients to describe low pass filter or a parametric description of the low pass filter.

Clause 32B. The device of any combination of clauses 25B-31B, wherein the occlusion metadata includes an indication of a location of the occlusion.

Clause 33B. The device of any combination of clauses 25B-32B, wherein the occlusion metadata includes first occlusion metadata for a first sound space of the two or more sound spaces and second occlusion metadata for a second sound space of the two or more sound spaces.

Clause 34B. The device of any combination of clauses 25B-33B, wherein the audio data comprises scene-based audio data.

Clause 35B. The device of any combination of clauses 25B-33B, wherein the audio data comprises object-based audio data.

Clause 36B. The device of any combination of clauses 25B-33B, wherein the audio data comprises channel-based audio data.

Clause 37B. A non-transitory computer-readable storage medium having stored thereon instructions that, when executed, cause one or more processors of a device to: obtain occlusion metadata representative of an occlusion within a soundfield in terms of propagation of sound through the occlusion, the occlusion separating the soundfield into two or more sound spaces; and specify, in a bitstream representative of audio data descriptive of the soundfield, the occlusion metadata to enable a renderer to be obtained by which to render the audio data into one or more speaker feeds that account for propagation of the sound in one of the two or more sound spaces.

It is to be recognized that depending on the example, certain acts or events of any of the techniques described herein can be performed in a different sequence, may be added, merged, or left out altogether (e.g., not all described acts or events are necessary for the practice of the techniques). Moreover, in certain examples, acts or events may be performed concurrently, e.g., through multi-threaded processing, interrupt processing, or multiple processors, rather than sequentially.

In some examples, the VR device (or the streaming device) may communicate, using a network interface coupled to a memory of the VR/streaming device, exchange messages to an external device, where the exchange messages are associated with the multiple available representations of the soundfield. In some examples, the VR device may receive, using an antenna coupled to the network interface, wireless signals including data packets, audio packets, video pacts, or transport protocol data associated with the multiple available representations of the soundfield. In some examples, one or more microphone arrays may capture the soundfield.

In some examples, the multiple available representations of the soundfield stored to the memory device may include a plurality of object-based representations of the soundfield, higher order ambisonic representations of the soundfield, mixed order ambisonic representations of the soundfield, a combination of object-based representations of the soundfield with higher order ambisonic representations of the soundfield, a combination of object-based representations of the soundfield with mixed order ambisonic representations of the soundfield, or a combination of mixed order representations of the soundfield with higher order ambisonic representations of the soundfield.

In some examples, one or more of the soundfield representations of the multiple available representations of the soundfield may include at least one high-resolution region and at least one lower-resolution region, and wherein the selected presentation based on the steering angle provides a greater spatial precision with respect to the at least one high-resolution region and a lesser spatial precision with respect to the lower-resolution region.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable gate arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various examples have been described. These and other examples are within the scope of the following claims.

What is claimed is:

1. A device comprising:

a memory configured to store audio data representative of a soundfield, the audio data comprising first audio data located in a first sound space of two or more sound spaces; and one or more processors coupled to the memory, and configured to:

obtain occlusion metadata representative of an occlusion within the soundfield in terms of propagation of sound through the occlusion, the occlusion separating the soundfield into the two or more sound spaces;

obtain a location of the device within the soundfield relative to the occlusion;

obtain, based on the occlusion metadata and the location, one or more renderers by which to render the audio data into one or more speaker feeds that account for propagation of the sound in the two or more sound spaces, wherein the one or more renderers includes a first renderer for the first audio data; and apply the one or more renderers to the audio data to generate the speaker feeds, wherein the speaker feeds include first speaker feeds obtained through application of the first renderer to the first audio data.

2. The device of claim 1, wherein the one or more processors are further configured to obtain environment metadata describing a virtual environment in which the device resides, and wherein the one or more processors are configured to obtain, based on the occlusion metadata, the location, and the environment metadata, the one or more renderers.

3. The device of claim 2, wherein the environment metadata describes a virtual indoor environment, and wherein the one or more processors are configured to obtain, when the environment metadata describes the virtual indoor environment, and based on the occlusion metadata and the location, a binaural room impulse response renderer as the first renderer.

4. The device of claim 2, wherein the environment metadata describes a virtual outdoor environment, and wherein the one or more processors are configured to obtain, when the environment metadata describes the virtual outdoor environment, and based on the occlusion metadata and the location, a head related transfer function renderer as the first renderer.

5. The device of claim 1, wherein the occlusion metadata includes a volume attenuation factor representative of an amount a volume associated with the audio data is reduced while passing through the occlusion.

6. The device of claim 1, wherein the occlusion metadata includes a direct path only indication representative of whether a direct path exists for the audio data or reverberation processing is to be applied to the audio data.

7. The device of claim 1, wherein the occlusion metadata includes a low pass filter description representative of coefficients to describe low pass filter or a parametric description of the low pass filter.

8. The device of claim 1, wherein the occlusion metadata includes an indication of a location of the occlusion.

9. The device of claim 1, wherein the occlusion metadata includes first occlusion metadata for the first sound space of the two or more sound spaces and second occlusion metadata for a second sound space of the two or more sound spaces, wherein the one or more processors are configured to:

obtain the first renderer by which to render at least the first audio data of the audio data into the first speaker feeds to model how the sound propagates in the first sound space;

obtain a second renderer by which to render at least second audio data of the audio data into one or more second speaker feeds to model how the sound propagates in the second sound space;

apply the first renderer to the first audio data to generate the first speaker feeds; and apply the second renderer to the second audio data to generate the second speaker feeds, and wherein the processor is further configured to obtain, based on the first speaker feeds and the second speaker feeds, the speaker feeds.

10. The device of claim 1, wherein the audio data comprises scene-based audio data.

11. The device of claim 1, wherein the audio data comprises object-based audio data.

12. The device of claim 1, wherein the audio data comprises channel-based audio data.

13. The device of claim 1, wherein the audio data comprises second audio data included in a second sound space of the two or more sound spaces, wherein the one or more processors are configured to obtain, based on the occlusion metadata and the location, a second renderer for the second audio data, and wherein the one or more processors are configured to:

apply the second renderer to the second audio data to obtain the second speaker feeds, and obtain, based on the first speaker feeds and the second speaker feeds, the speaker feeds.

14. The device of claim 1, wherein the device includes a virtual reality headset coupled to one or more speakers configured to reproduce, based on the speaker feeds, the soundfield.

15. The device of claim 1, wherein the device includes an augmented reality headset coupled to one or more speakers configured to reproduce, based on the speaker feeds, the soundfield.

16. The device of claim 1, wherein the device includes one or more speakers configured to reproduce, based on the speaker feeds, the soundfield.

17. A method comprising:

obtaining, by a device, occlusion metadata representative of an occlusion within a soundfield in terms of propagation of sound through the occlusion, the occlusion separating the soundfield into two or more sound spaces, the audio data comprising first audio data located in a first sound space of the two or more sound spaces;

obtaining, by the device, a location of the device within the soundfield relative to the occlusion;

obtaining, by the device, based on the occlusion metadata and the location, one or more renderers by which to render audio data representative of the soundfield into one or more speaker feeds that account for propagation of the sound in the two or more sound spaces, wherein the one or more renderers includes a first renderer for the first audio data; and applying, by the device, the one or more renderers to the audio data to generate the speaker feeds, wherein the speaker feeds include first speaker feeds obtained through application of the first renderer to the first audio data.

18. The method of claim 17, further comprising obtaining environment metadata describing a virtual environment in which the device resides, wherein obtaining the one or more renderers comprises obtaining, based on the occlusion metadata, the location, and the environment metadata, the one or more renderers.

19. The method of claim 18, wherein the environment metadata describes a virtual indoor environment, and wherein obtaining the one or more renderers comprises obtaining, when the environment metadata describes the virtual indoor environment, and based on the occlusion metadata and the location, a binaural room impulse response renderer as the first renderer.

20. The method of claim 18, wherein the environment metadata describes a virtual outdoor environment, and wherein obtaining the one or more renderers comprises obtaining, when the environment metadata describes the virtual outdoor environment, and based on the occlusion metadata and the location, a head related transfer function renderer as the first renderer.

21. The method of claim 17, wherein the occlusion metadata includes a volume attenuation factor representative of an amount a volume associated with the audio data is reduced while passing through the occlusion.

22. The method of claim 17, wherein the occlusion metadata includes a direct path only indication representative of whether a direct path exists for the audio data or reverberation processing is to be applied to the audio data.

23. The method of claim 17, wherein the occlusion metadata includes a low pass filter description representative of coefficients to describe low pass filter or a parametric description of the low pass filter.

24. The method of claim 17, wherein the occlusion metadata includes an indication of a location of the occlusion.

25. The method of claim 17, wherein the occlusion metadata includes first occlusion metadata for the first sound space of the two or more sound spaces and second occlusion metadata for a second sound space of the two or more sound spaces, wherein obtaining the one or more renderers comprises:

obtaining the first renderer by which to render at least the first audio data into the first speaker feeds to model how the sound propagates in the first sound space; and obtaining a second renderer by which to render at least second audio data of the audio data into one or more second speaker feeds to model how the sound propagates in the second sound space, and wherein applying the renderer comprises:

applying the first renderer to the first audio data to generate the first speaker feeds;

applying the second renderer to the second audio data to generate the second speaker feeds; and wherein the method further comprises obtaining, based on the first speaker feeds and the second speaker feeds, the speaker feeds.

26. The method of claim 17, wherein the audio data comprises second audio data included in a second sound space of the two or more sound spaces, and wherein the method further comprises:

obtaining, based on the occlusion metadata and the location, a second renderer for the second audio data, applying the second renderer to the second audio data to obtain the second speaker feeds, and obtaining, based on the first speaker feeds and the second speaker feeds, the speaker feeds.

27. A device comprising:

a memory configured to store audio data representative of a soundfield, the audio data comprising first audio data located in a first sound space of two or more sound spaces; and one or more processors coupled to the memory, and configured to:

obtain occlusion metadata representative of an occlusion within the soundfield in terms of propagation of sound through the occlusion, the occlusion separating the soundfield into the two or more sound spaces; and specify, in a bitstream representative of the audio data, the occlusion metadata to enable one or more renderers to be obtained by which to render the audio data into one or more speaker feeds that account for propagation of the sound in the two or more sound spaces, wherein the one or more renderers includes a first renderer for the first audio data, and wherein the speaker feeds include first speaker feeds to be obtained through application of the first renderer to the first audio data.

28. A method comprising:

obtaining, by a device, occlusion metadata representative of an occlusion within a soundfield in terms of propagation of sound through the occlusion, the occlusion separating the soundfield into two or more sound spaces; and specifying, by the device, in a bitstream representative of audio data descriptive of the soundfield, the occlusion metadata to enable one or more renderers to be obtained by which to render the audio data into one or more speaker feeds that account for propagation of the sound in one of the two or more sound spaces, wherein the audio data comprising first audio data located in a first sound space of two or more sound spaces, wherein the one or more renderers includes a first renderer for the first audio data, and wherein the speaker feeds include first speaker feeds to be obtained through application of the first renderer to the first audio data.

* * * * *